US012559881B2

(12) United States Patent
Kim et al.

(10) Patent No.: US 12,559,881 B2
(45) Date of Patent: Feb. 24, 2026

(54) APPARATUS FOR TREATING LAUNDRY AND CONTROL METHOD THEREOF

(71) Applicant: LG Electronics Inc., Seoul (KR)

(72) Inventors: Minji Kim, Seoul (KR); Hyuksoo Lee, Seoul (KR); Yeonju Lee, Seoul (KR); Hyeonjoong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 840 days.

(21) Appl. No.: 17/467,014

(22) Filed: Sep. 3, 2021

(65) Prior Publication Data

US 2022/0074119 A1 Mar. 10, 2022

(30) Foreign Application Priority Data

Sep. 4, 2020 (KR) ..... 10-2020-0113074

(51) Int. Cl.
*D06F 58/20* (2006.01)
*D06F 37/38* (2006.01)
(Continued)

(52) U.S. Cl.
CPC ..... *D06F 58/206* (2013.01); *D06F 58/02* (2013.01); *D06F 58/46* (2020.02); *D06F 37/38* (2013.01); *D06F 2103/10* (2020.02); *D06F 2103/24* (2020.02); *D06F 2103/50* (2020.02); *D06F 2105/48* (2020.02)

(58) Field of Classification Search
None
See application file for complete search history.

(56) References Cited

U.S. PATENT DOCUMENTS 4,586,267 A * 5/1986 Sussman ..... D06F 34/08 34/490
4,713,894 A * 12/1987 Roth ..... D06F 58/38 34/562
(Continued)

FOREIGN PATENT DOCUMENTS

CN 101583751 A 11/2009
CN 103415659 A 11/2013
(Continued)

OTHER PUBLICATIONS

International Search Report and Written Opinion in International Appln. No. PCT/KR2021/011921, dated Dec. 22, 2021, 10 pages (with English translation).
(Continued)

*Primary Examiner* — David J Laux
(74) *Attorney, Agent, or Firm* — Fish & Richardson P.C.

(57) ABSTRACT

A method for controlling a laundry treating apparatus includes an air supplying step of supplying heated air to the drum through the heat exchange part and a first motion executing step executed while the air supplying step is in progress. The first motion executing step alternately executes a first acceleration mode of rotating the drum at an rpm inducing a centrifugal force equal to or greater than 1G along one of a clockwise direction and a counterclockwise direction and a first deceleration mode of rotating the drum at an rpm inducing a centrifugal force smaller than 1G in a direction equal to a rotational direction set for the first acceleration mode.

19 Claims, 15 Drawing Sheets

(51) Int. Cl.

| | |
|---|---|
| ***D06F 58/02*** | (2006.01) |
| ***D06F 58/46*** | (2020.01) |
| ***D06F 103/10*** | (2020.01) |
| ***D06F 103/24*** | (2020.01) |
| ***D06F 103/50*** | (2020.01) |
| ***D06F 105/48*** | (2020.01) |

(56) References Cited

U.S. PATENT DOCUMENTS

| | | | | |
|---|---|---|---|---|
| 11,293,127 | B2 | 4/2022 | Kwon et al. | |
| 2003/0097764 | A1* | 5/2003 | St. Louis | D06F 34/10 34/526 |
| 2010/0024243 | A1* | 2/2010 | Ricklefs | D06F 58/203 34/474 |
| 2011/0030150 | A1* | 2/2011 | Ashrafzadeh | D06F 58/36 68/19 |
| 2011/0036556 | A1* | 2/2011 | Bison | D06F 58/48 62/238.7 |
| 2014/0020260 | A1* | 1/2014 | Carow | D06F 58/36 34/427 |
| 2014/0090181 | A1* | 4/2014 | Janke | D06F 33/48 68/12.04 |
| 2014/0379142 | A1* | 12/2014 | Borlin | D06F 37/225 700/279 |
| 2015/0040417 | A1* | 2/2015 | Arcarons | D06F 58/04 34/130 |
| 2015/0176179 | A1* | 6/2015 | Ashrafzadeh | D06F 34/16 68/3 R |
| 2016/0273153 | A1* | 9/2016 | Nam | D06F 58/44 |
| 2019/0169783 | A1* | 6/2019 | Seo | D06F 58/38 |
| 2020/0149207 | A1* | 5/2020 | Kim | D06F 39/04 |
| 2020/0190720 | A1* | 6/2020 | Noh | D06F 33/00 |

FOREIGN PATENT DOCUMENTS

| | | | |
|---|---|---|---|
| CN | 103443353 | A | 12/2013 |
| CN | 107724028 | | 2/2018 |
| CN | 107747204 | A | 3/2018 |
| EP | 3492648 | | 6/2019 |
| JP | 1993-130760 | A | 5/1993 |
| JP | 2004-230063 | A | 8/2004 |
| JP | 2008-119092 | A | 5/2008 |
| JP | 2010104579 | | 5/2010 |
| JP | 2013150659 | | 8/2013 |
| KR | 10-1992-0016646 | A | 9/1992 |
| KR | 10-2005-0000593 | A | 1/2005 |
| KR | 20170111261 | | 10/2017 |
| KR | 10-2018-0052961 | A | 5/2018 |
| KR | 10-2018-0072336 | A | 6/2018 |
| KR | 10-2020-0066169 | A | 6/2020 |
| KR | 10-2020-0073063 | A | 6/2020 |
| WO | WO 2002/42541 | A1 | 5/2002 |
| WO | 2014/187494 | A1 | 11/2014 |

OTHER PUBLICATIONS

Extended European Search Report in European Appln. No. 21194829.4, dated Feb. 18, 2022, 8 pages.

Office Action in Korean Appln. No. 10-2020-0113074, mailed on May 27, 2024, 25 pages (with English translation).

Office Action in Australian Appln. No. 2021336000, mailed on Jul. 22, 2024, 5 pages.

Office Action in Japanese Appln. No. 2023-514972, mailed on Oct. 29, 2024, 7 pages (with English translation).

Office Action in Chinese Appln. No. 202180054814.1, mailed on May 23, 2025, 21 pages (with English translation).

* cited by examiner

APPARATUS FOR TREATING LAUNDRY AND CONTROL METHOD THEREOF

CROSS-REFERENCE TO RELATED APPLICATION

This application claims the benefit of Korean Patent Application No. 10-2020-0113074, filed on Sep. 4, 2020, which is hereby incorporated by reference as if fully set forth herein.

TECHNICAL FIELD

The present disclosure relates to an apparatus for treating laundry and control method thereof.

BACKGROUND

A laundry treatment device is a device capable of washing, drying or both washing and drying of laundry (e.g., a washing target or a drying target) and conceptually includes a washer, a dryer or a washer & dryer.

A laundry treatment device (i.e., a dryer) capable of drying laundry is classified into an exhaust drying system or a circulation drying system depending on how to handle air having finished heat exchange with laundry in supplying heated air (i.e., hot air) to the laundry.

The circulation drying system is a system of sequentially progressing dehumidification and heating of air discharged from a laundry stored receiving space and then resupplying the air to the receiving space, while the exhaust drying system is a system of supplying heated air to the receiving space but exhausting the air, which is discharged from the receiving space, out of a laundry treatment device.

Since a drying time taken for laundry to reach a setup target dryness degree is determined depending on how effective the heat exchange between laundry and air supplied to a drum, control to increase the heat exchange efficiency of the laundry and the air supplied into the drum for any laundry treatment device with any drying system is a very important design consideration in laundry treatment devices for the purpose of drying laundry.

One of the laundry treatment devices of the related art uses a control method of increasing a contact area between laundry and air by controlling an rpm (revolutions per minute) of a drum while the air is supplied to the drum (registration number 10-1594368). However, the laundry treatment device of the related art has a disadvantage that a motion of a drum is uncontrollable individually during a preheating period, a constant drying rate period, and a falling drying rate period. Namely, according to the related art control method, since air supplied to a drum can be prevented from being discharged to a tub through a drum perforated hole formed in a circumferential surface of the drum only if the rpm of the drum is maintained at an rpm that induces a centrifugal force over 1G, it is disadvantageous in that it is difficult to decrease the rpm of the drum into an rpm that induces a centrifugal force below 1G while the air is supplied to the drum.

Moreover, according to the related art control method, it may be disadvantageous in causing damage to laundry in the preheating period and the falling drying rate period. The preheating period is the period in which the temperature of laundry increases gradually (i.e., the period in which the temperature of laundry increases gradually to a temperature of discharging moisture from laundry) while a dryness degree barely changes (a moisture content barely changes).

The constant drying rate period is the period in which a dryness degree of laundry rapidly increases (or a moisture content rapidly decreases) and the temperature of laundry is maintained almost uniform. The falling drying rate period is the period in which a dryness degree of laundry barely changes but the temperature of the laundry increases rapidly. If a frictional force between the laundry and the drum increases in the preheating period and the falling drying rate period (i.e., if a big centrifugal force is continuously provided to the laundry), it is disadvantageous in that the laundry may be fluffed or damaged.

On the other hand, among the control methods of the laundry treatment device of the related art, there was a method of controlling a laundry treatment device in a manner of dividing a drying process into a preheating period, a constant drying rate period and a falling drying rate period (application number 10-2006-0023715). Yet, such a control method fails to disclose how to control the rpm and rotational direction of a drum per period is advantageous in reducing a drying time and improving drying performance.

In addition, one of the laundry treatment devices of the related art was provided with a control method of adjusting an rpm of a drum according to a dryness degree. The control method described above is applied to a laundry treatment device equipped with an exhaust drying system, which means heating the air outside the drum and supplying it to the drum, but throwing the air outside the drum after heat exchange with laundry.

In the early stage of a drying course (e.g., a preheating period), the temperature of the air discharged from a drum tends to increase slowly, the temperature of the air discharged from the drum tends to remain almost constant in the mid-stage of the drying course (evaporation period), and the temperature of the air discharged from the drum tends to increase again in the last stage (overheating period) of the drying course. Therefore, the related art laundry treatment device with the exhaust drying system was able to determine the progression point (i.e., a dryness degree of laundry) of the drying course by measuring the temperature of the air discharged from the drum.

However, the control method described above had a disadvantage that it was difficult to accurately determine which of the above periods configuring the drying course is being executed by the laundry treatment device. This is because the temperature of the air discharged from the drum is changed depending on how much heat exchange is made between the air and the laundry.

SUMMARY

One technical task of the present application is to provide an apparatus for treating laundry and control method thereof capable of minimizing damage caused to laundry and reducing a drying time by controlling at least one of an rpm and a rotational direction for each period of a drying process divided into a preheating period, a constant drying rate period and a falling drying rate period.

Another technical task of the present application is to provide an apparatus for treating laundry and control method thereof capable of minimizing a frictional force between laundry and a drum in the early stage of drying and creases from the laundry.

Another technical task of the present application is to provide an apparatus for treating laundry and control method thereof capable of minimizing the damage caused to laundry by a frictional force in the last stage of drying.

Further technical task of the present application is to provide an apparatus for treating laundry and control method thereof capable of facilitating the sensing of a dryness degree of laundry.

Another further technical task of the present application is to provide an apparatus for treating laundry and control method thereof capable of facilitating the adjustments of an rpm and rotational direction of a drum.

Technical tasks obtainable from the present invention are non-limited by the above-mentioned technical task. And, other unmentioned technical tasks can be clearly understood from the following description by those having ordinary skill in the technical field to which the present invention pertains.

Additional advantages, objects, and features of various embodiments for a display device will be set forth in the disclosure herein as well as the accompanying drawings. Such aspects may also be appreciated by those skilled in the art based on the disclosure herein.

To achieve these objects and other advantages and in accordance with the purpose of the disclosure, as embodied and broadly described herein, a method of controlling a laundry treating apparatus according to one embodiment of the present disclosure may include an air supplying step of supplying heated air to the drum through the heat exchange part and a first motion executing step executed while the air supplying step is in progress.

The first motion executing step may be configured to alternately execute a first acceleration mode of rotating the drum at an rpm inducing a centrifugal force equal to or greater than 1G along one of a clockwise direction and a counterclockwise direction and a first deceleration mode of rotating the drum at an rpm inducing a centrifugal force smaller than 1G in a direction equal to a rotational direction set for the first acceleration mode.

The alternate execution of the first acceleration mode and the first deceleration mode may be configured to be repeated at least twice.

The air supplying step may be divided into a preheating period, a constant drying rate period and a falling drying rate period and the first motion executing step may be executed in a partial or whole period of the preheating period.

The first motion executing step may be performed until a dryness degree of the laundry reaches a preset first reference dryness degree.

The exhaust duct and the supply duct may be connected together to configure a circulation flow path of air, the heat exchange part may include a refrigerant pipe forming a flow path having a refrigerant circulating therein, a heat absorbing part transferring heat of air flowing into the exhaust duct to the refrigerant, a heating part transferring heat of the refrigerant to air having passed through the heat absorbing part, and a compressor enabling the refrigerant to circulate along the refrigerant pipe, and the first reference dryness degree may be determined based on whether a temperature of the refrigerant discharged from the compressor reaches a preset first refrigerant temperature.

If the temperature of the air discharged from the drum reaches a preset reference air temperature, the dryness degree of the laundry may be determined as reaching the first reference dryness degree.

The method may include a second motion executing step of alternately executing a second acceleration mode of rotating the drum at an rpm inducing a centrifugal force equal to or greater than 1G along one of a clockwise direction and a counterclockwise direction and a second deceleration mode of rotating the drum at an rpm inducing a centrifugal force smaller than 1G in a direction equal to a rotational direction set for the second acceleration mode, and the second reference dryness degree may be executed in a partial or whole period of the falling drying rate period.

The second motion executing step may end if the dryness degree of the laundry reaches a second reference dryness degree set smaller than a target dryness degree set for the air supplying step.

The exhaust duct and the supply duct may be connected together to configure a circulation flow path of air, the heat exchange part may include a refrigerant pipe forming a flow path having a refrigerant circulating therein, a heat absorbing part transferring heat of air flowing into the exhaust duct to the refrigerant, a heating part transferring heat of the refrigerant to air having passed through the heat absorbing part, and a compressor enabling the refrigerant to circulate along the refrigerant pipe, and the second reference dryness degree may be determined based on whether a temperature of the refrigerant discharged from the compressor reaches a preset second refrigerant temperature.

A ratio of an execution time of the first acceleration mode to an execution time of the first deceleration mode may be set different from that of the second acceleration mode to the second deceleration mode.

The execution time set for the first acceleration mode may be set longer than the execution time set for the first deceleration mode.

The ratio of the execution time of the first acceleration mode to the execution time of the first deceleration mode may be set to 3:1~10:1.

An execution time set for the second acceleration mode may be set equal to or longer than an execution time set for the second deceleration mode.

The ratio of the execution time of the second acceleration mode to the execution time of the second deceleration mode may be set to 1:1~3:1.

The method may further include an agitating motion executing step of alternately performing a clockwise rotation and a counterclockwise rotation of the drum at the rpm inducing the centrifugal force smaller than 1G and the agitating motion executing step may be executed in the constant drying rate period.

The method may further include a dispersal motion executing step of being executed before initiation of the first motion executing step and alternately performing the clockwise rotation and the counterclockwise rotation of the drum at the rpm inducing the centrifugal force smaller than 1G.

An rpm of the drum set in the dispersal motion executing step may be set lower than the rpm of the drum set in the agitating motion executing step.

The method may further include a sensing motion executing step of rotating the drum at an rpm lower than the rpm set in the dispersal motion executing step after completion of the second motion executing step and a sensing step of measuring the dryness degree of the laundry via electrodes provided to contact with the laundry located under a horizontal line passing through a rotation center of the drum. If the dryness degree of the laundry measured in the sensing step is equal to or higher than a target dryness degree set for the air supplying step, the air supplying step may be ended.

In another aspect of the disclosure, as embodied and broadly described herein, a method of controlling a laundry treating apparatus including a drum providing a space for storing laundry therein, a fixed panel provided to a location spaced apart from a rear side of the drum, a stator fixed to the fixed panel to form a rotating field, a rotor configured to be rotated by the rotating field to generate power required for rotation of the drum, a panel outlet configured to perforate the fixed panel, an exhaust duct guiding air discharged from the drum to the panel outlet, a heat exchange part dehumidifying and heating air moving along the exhaust duct, an inlet configured in a manner that a multitude of perforated holes configured to perforate the fixed panel are disposed to enclose the rotor, an air inlet configured in a manner that a multitude of perforated holes perforating the rear side of the drum are disposed to form a ring enclosing a rotation center of the drum, a flow path forming part having one end fixed to the fixed panel to enclose the inlet and the other end contacting with the drum to enclose the air inlet, and a supply duct fixed to the fixed panel to guide air discharged from the panel outlet to the inlet according to another embodiment of the present disclosure may include an air supplying step of supplying heated air to the drum through the heat exchange part and a motion executing step executed while the air supplying step is in progress.

The motion executing step alternately may be configured to execute an acceleration mode of rotating the drum at an rpm inducing a centrifugal force equal to or greater than 1G along one of a clockwise direction and a counterclockwise direction and a deceleration mode of rotating the drum at an rpm inducing a centrifugal force smaller than 1G in a direction equal to a rotational direction set for the acceleration mode.

The air supplying step may be divided into a preheating period, a constant drying rate period and a falling drying rate period, and the motion executing step may be executed in at least one of the preheating period or the falling drying rate period.

The air inlet may be provided to a location capable of discharging air to the laundry adhering closely to a circumferential surface of the drum.

A radius of the ring formed by the air inlet may be set equal to or greater than ½ of a radius of the rear side of the drum.

In another aspect of the disclosure, as embodied and broadly described herein, a method of controlling a laundry treating apparatus including a drum providing a space for storing laundry therein, a fixed panel provided to a location spaced apart from a rear side of the drum, a housing fixed to the fixed panel, a stator fixed to the housing to form a rotating field, a rotor configured to be rotated by the rotating field to generate power required for rotation of the drum, a ring gear fixed to an inside of the housing, a first shaft having one end fixed to the rotor and the other end located within the housing, a driver gear located within the housing by being fixed to the first shaft, a second shaft having one end fixed to the rear cover by penetrating the fixed panel and the other end located within the housing so as to form a concentric axis with the first shaft, a base located within the housing and having the other end of the second shaft fixed thereto, a driven gear having a first body rotatably fixed to the base, a first gear provided to a circumferential surface of the first body to engage with the driver gear, a second body fixed to the first body and having a diameter smaller than that of the first body, and a second gear provided to a circumferential surface of the second body to engage with the ring gear, a panel outlet configured to perforate the fixed panel, an exhaust duct guiding air discharged from the drum to the panel outlet, a heat exchange part dehumidifying and heating air moving along the exhaust duct, an inlet configured in a manner that a multitude of perforated holes configured to perforate the fixed panel are disposed to enclose the rotor, an air inlet configured in a manner that a multitude of perforated holes perforating the rear side of the drum are disposed to form a ring enclosing a rotation center of the drum, a flow path forming part having one end fixed to the fixed panel to enclose the inlet and the other end contacting with the drum to enclose the air inlet, and a supply duct fixed to the fixed panel to guide air discharged from the panel outlet to the inlet according to another embodiment of the present disclosure may include an air supplying step of supplying heated air to the drum through the heat exchange part and a motion executing step executed while the air supplying step is in progress.

The motion executing step may be configured to alternately execute an acceleration mode of rotating the drum at an rpm inducing a centrifugal force equal to or greater than 1G along one of a clockwise direction and a counterclockwise direction and a deceleration mode of rotating the drum at an rpm inducing a centrifugal force smaller than 1G in a direction equal to a rotational direction set for the acceleration mode.

The air supplying step may be divided into a preheating period, a constant drying rate period and a falling drying rate period, and the motion executing step may be executed in at least one of the preheating period or the falling drying rate period.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

Accordingly, embodiments of the present invention provide various effects and/or features of a mobile terminal.

First of all, the present application has an effect of providing an apparatus for treating laundry and control method thereof capable of minimizing damage caused to laundry and reducing a drying time by controlling at least one of an rpm and a rotational direction for each period of a drying process divided into a preheating period, a constant drying rate period and a falling drying rate period.

Secondly, the present application has an effect of providing an apparatus for treating laundry and control method thereof capable of minimizing a frictional force between laundry and a drum in the early stage of drying and creases from the laundry.

Thirdly, the present application has an effect of providing an apparatus for treating laundry and control method thereof capable of minimizing the damage caused to laundry by a frictional force in the last stage of drying.

Fourthly, the present application has an effect of providing an apparatus for treating laundry and control method thereof capable of facilitating the sensing of a dryness degree of laundry.

Fifthly, the present application has an effect of providing an apparatus for treating laundry and control method thereof capable of facilitating the adjustments of an rpm and rotational direction of a drum.

Effects obtainable from the present disclosure may be non-limited by the above-mentioned effects. And, other unmentioned effects can be clearly understood from the following description by those having ordinary skill in the technical field to which the present disclosure pertains.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. The above and other aspects, features, and advantages of the present invention will become more apparent upon consideration of the following description of preferred embodiments, taken in conjunction with the accompanying drawing figures.

FIGS. 14A and 14B show one example of an agitation mode, in which FIGS. 14A and 14B show clockwise and counterclockwise rotations of a drum, respectively.

DETAILED DESCRIPTION

Reference will now be made in detail to the preferred embodiments of the present disclosure, examples of which are illustrated in the accompanying drawings. Meanwhile, elements or control method of apparatuses which will be described below are only intended to describe the embodiments of the present disclosure and are not intended to restrict the scope of the present disclosure. Wherever possible, the same reference numbers will be used throughout the drawings to refer to the same or like parts.

Figure 1:
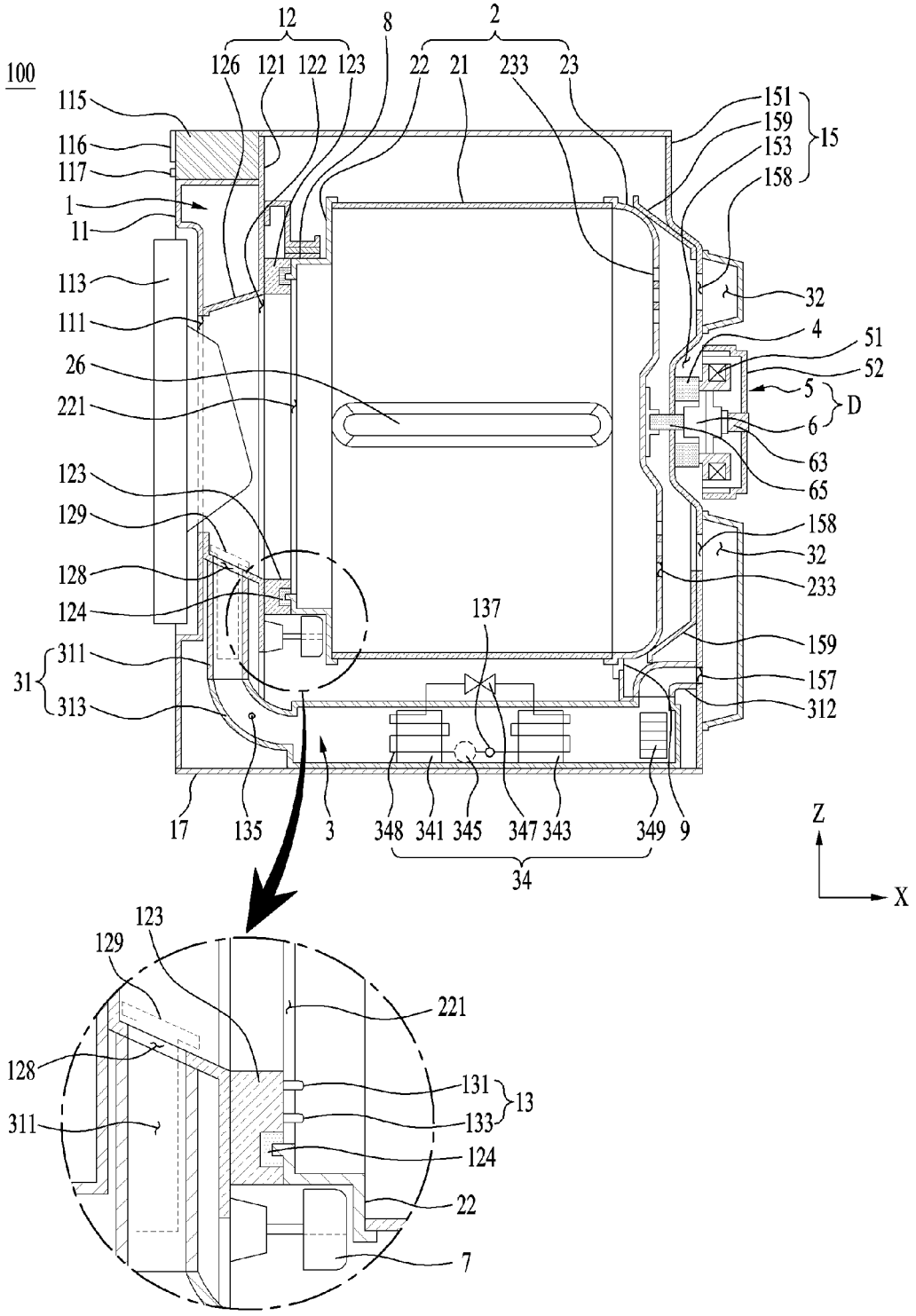
FIG. 1 and FIG. 2 are diagrams showing one example of a laundry treating apparatus.

FIG. 1 is a diagram showing one example of a laundry treating apparatus 100. The laundry treating apparatus 100 may include a cabinet 1, a drum 2 rotatably provided within the cabinet 1 to provide a space for storing laundry (e.g., a washing object or a drying object) therein, a supply part 3 removing moisture from laundry by supplying hot dry air (e.g., air at the temperature higher than room temperature, air at a dryness degree higher than that of room air, etc.), and a drive part D rotating the drum.

The cabinet 1 includes a front panel 11 forming a front side of the laundry treating apparatus and a base panel 17 forming a bottom side of the laundry treating apparatus. An entrance 111 communicating with the drum 2 may be formed in the front panel 11 and configured to be closed by a door 113.

A control panel 115 is provided to the front panel 11. An input unit 116 receiving an input of a control command from a user and a display unit 117 outputting information such as a user-selectable control command and the like may be provided to the control panel 115. The input unit 116 may include a power supply request unit making a request for power supply to the laundry treating apparatus 100, a course input unit enabling a user-desired course to be selected, and an execution request unit making a request for initiation of a user-selected course.

The drum 2 may be configured in a hollow cylindrical shape. FIG. 1 shows an example of a case that the drum 2 includes a drum body 21 in a cylindrical shape having an open front side and an open rear side, a front cover 22 forming a front side of the drum body 21, and a rear cover 23 forming a rear side of the drum body 21. A drum entrance enabling an inside of the drum body 21 to communicate with an outside may be provided to the front cover 22.

A lifter 26 may be further included in the drum body 21. The lifter 26 may be configured in a manner that a board extended from the front cover 22 toward the rear cover 23 is projected from the drum body 21 toward a rotation center of the drum 2 (i.e., projected from a circumferential surface of the drum toward the rotation center of the drum).

In case that the laundry treating apparatus 100 is provided as a device for the laundry drying only, a drum perforated hole configured to perforate the drum body 21 to enable an inside of the drum to communicate with an outside of the drum may not be provided to the drum 2.

The drum 2 may be rotatably fixed to at least one of a first body support part 12 and a second body support part 15. FIG. 1 shows an example of a case that the rear cover 23 is rotatably fixed to the second body support part 15 via the drive part D and that the front cover 22 is rotatably connected to the first body support part 12.

The first body support part 12 may include a support panel 121 located between the front panel 11 and the front cover 22 by being fixed to the cabinet 1. FIG. 1 shows an example of a case that the support panel 121 is fixed to the base panel 17 and located between the front panel 11 and the front cover 22. In this case, a rear side (i.e., a side that faces the support panel) of the front panel 11 may be fixed to the support panel 121 and a bottom end may be fixed to the base panel 17.

The support panel 121 may include a support panel perforated hole 122, a drum connecting body 123 connecting the support panel perforate hole 122 and the drum entrance 221, and a panel connecting body 126 connecting the support panel perforated hole 122 and the entrance 111 to each other. The support panel perforated hole 122 is a means for enabling the entrance 111 and the drum entrance 221 to communicate with each other in a manner of being configured to perforate the support panel 121.

The drum connecting body 123 may include a pipe fixed to a rear side (i.e., a side that faces the drum entrance in a space provided by the support panel) of the support panel 121. One end of the drum connecting body 123 may be configured to enclose the support panel perforated hole 122, and a free end of the drum connecting body 123 may be configured to support the front cover 22. Namely, the free end of the drum connecting body 123 may be configured to be inserted in the drum entrance 221 or contact with a free end of the front cover 22 forming the drum entrance 221.

FIG. 1 shows an example of a case that the free end of the drum connecting body 123 contacts with the free end of the front cover 22. In this case, a damper 124 (i.e., a connecting damper) in a ring shape may be provided to the drum connecting body 123. The connecting damper 124 is a means for minimizing a risk that the drum entrance 221 is separated from the drum connecting body 123 on rotation or vibration of the drum 2 (e.g., a risk that air in the drum leaks to the cabinet).

The connecting damper 124 may be formed on compressive material (e.g., material capable of increasing/decreasing a volume by an external force). In this case, the connecting damper 124 may be configured to maintain a compressed state between the free end of the drum connecting body 123 and an edge (i.e., the free end of the front cover) of the drum entrance 221 (configured to maintain the compressed state by a rear support part described later). This is to minimize the separation of the drum entrance 221 from the drum connecting body 123 when the drum 2 vibrates between the support panel 121 and the fixed panel 151. A felt fabricated by compressing fiber may become one example of the connecting damper 124.

The panel connecting body 126 may include a pipe fixed to a front side (e.g., a side facing the front panel in the space provided by the support panel) of the support panel 121. One end of the panel connecting body 126 may be configured to enclose the support panel perforated hole 122, and the other end of the panel connecting body 126 may be configured to be connected to the entrance 111. Hence, laundry supplied into the entrance 111 may move to the drum body 21 through the panel connecting body 126, the support panel perforated hole 122, the drum connecting body 123 and the drum entrance 221.

The second body support part 15 may include a fixed panel 151 fixed to the cabinet 1 so as to be located at a position spaced apart from the rear cover 23. FIG. 1 shows an example of a case that the fixed panel 151 is fixed to the base panel 17 so as to form a rear side (i.e., the rear side of the cabinet) of the laundry treating apparatus 100.

Figure 2:
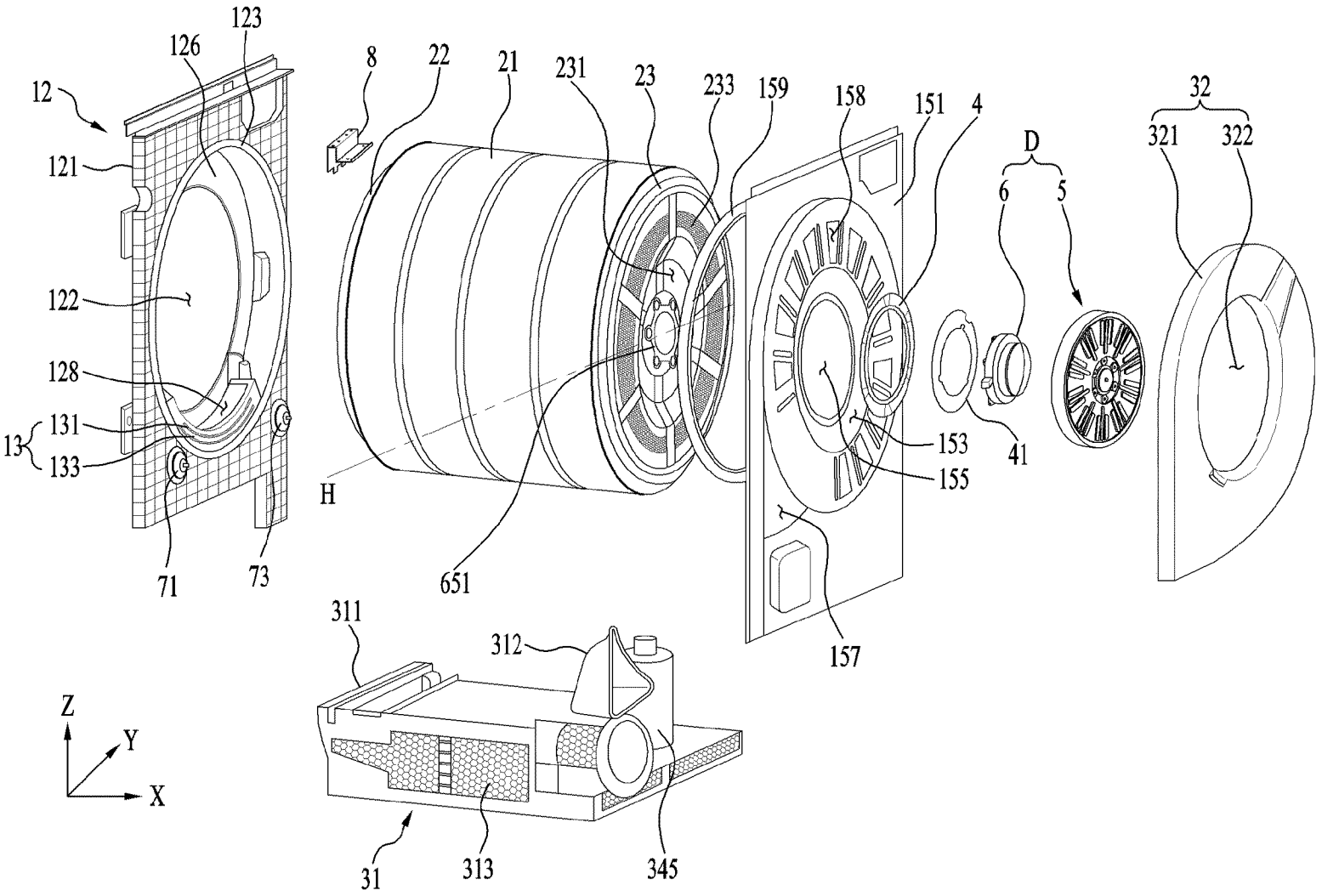

As shown in FIG. 2, a drive part installation recess 153 providing a space for installing the drive part D therein may be provided to the fixed panel 151. The drive part installation recess 153 may include a recess configured in a manner that the fixed panel 151 is concavely bent toward the rear cover 23 of the drum. A fixed panel perforated hole 155 penetrated by the rotating shaft of the drum 2 is provided to the fixed panel 151, and may be located in the drive part installation recess 153.

As described above, if the drum 2 includes the drum body 21, the front cover 22 fixed to the drum body 21, and the rear cover 23 fixed to the drum body 21, rigidity of the drum is increased more than that of the structure that the open front side and the open rear side of the drum body 21 are rotatably connected to the support panel 121 and the fixed panel 151, respectively. If the rigidity of the drum is increased, deformation of the drum body 21 can be minimized during the rotation of the drum, thereby minimizing the problem that laundry is stuck in a space between the drum body and the support panel or a space between the drum body and the fixed panel due to the deformation of the drum body 21 (i.e., the load of the drive part can be minimized).

A drum outlet (or a first outlet) 128 may be provided to the support panel 121, and a panel outlet (or a second outlet) 157 and an inlet 158 may be provided to the fixed panel 151. The first outlet 128 may include a hole that passes through the panel connecting body 126.

The inlet 158 may be configured in a manner that a multitude of perforate dholes configured to penetrate the fixed panel 151 are disposed to enclose the drive part installation recess 153 (e.g., a multitude of the perforated holes may be configured to form a ring that encloses the drive part installation recess).

As shown in FIG. 1, the supply part 3 may include an exhaust duct 31 connecting the first outlet 128 and the second outlet 157 to each other, a supply duct 32 guiding air discharged through to the second outlet 157 to the inlet 158, and a heat exchange part 34 provided to the exhaust duct 31 to sequentially execute dehumidification and heating of air. A filter 129 filtering air moving from the drum 2 to the exhaust duct 31 may be provided to the first outlet 128.

The exhaust duct 31 may include a first duct 311 connected to the first outlet 128, a second duct 312 connected to the second outlet 157, and a third duct 313 connecting the first duct 311 and the second duct 312 together. The third duct 313 may be fixed to the base panel 17.

The heat exchange part 34 may include various devices capable of executing dehumidification and heating of air that flows into the exhaust duct 31. FIG. 1 shows an example of a case that the heat exchange part 34 includes a heat pump and a fan 349.

Particularly, the heat exchange part 34 shown in FIG. 1 includes a first heat exchanger (e.g., a heat absorbing part) 341 removing moisture from air flowing into the exhaust duct 31, a second heat exchanger (e.g., a heating part) 343 provided within the exhaust duct 31 to heat the air having passed through the heat absorbing part 341, and a fan 359 moving the air discharged from the drum 2 to the supply duct 32 via the heat absorbing part and the heating part in order. FIG. 1 shows an example of a case that the fan 349 is located between the heating part 343 and the second duct 312.

The heat absorbing part 341 and the heating part 343 are disposed in order along a moving direction of air and connected to each other through a refrigerant pipe 348 forming a circulation flow path of a refrigerant. The refrigerant is moved by a compressor 345 located outside the exhaust duct 31 along the refrigerant pipe 348, and a pressure regulator 347 regulating a pressure of the refrigerant moving from the heating part 343 to the heat absorbing part 341 is provided to the refrigerant pipe 348.

The heat absorbing part 341 is a means for cooling air (e.g., evaporating a refrigerant) by transferring heat of air flowing into the exhaust duct 31 to the refrigerant, and the heating part 343 is a means for heating air (e.g., condensing a refrigerant) by transferring heat of the refrigerant having passed through the compressor 345 to the air.

As shown in FIG. 2, the supply duct 32 is a means for guiding the air discharged through the second outlet 157 to the inlet 158 by being fixed to the fixed panel 151.

In case that the inlet 158 includes a multitude of perforated holes disposed in a ring shape, the supply duct 32 may include a duct body 321 fixed to the fixed panel 151 and forming a flow path connecting the second outlet 157 and the inlet 158 to each other and a rotor receiving part 322 configured to penetrate the duct body 321. The supply duct 32 including the duct body 321 and the rotor receiving part 322 forms a flow path in a ring shape approximately, and the drive part D fixed to the drive part installation recess 153 is exposed to an outside of the supply duct 32 by the rotor receiving part 322.

To supply the air supplied into the cabinet 1 through the inlet 158 to the drum 2, an air inlet 233 configured to perforate the rear cover 23 may be provided to the drum 2 and a flow path forming part 159 guiding the air discharged from the inlet 158 to the air inlet 233 may be provided to the fixed panel 151.

The air inlet 233 may be configured in a manner that a multitude of holes perforating the rear cover 23 form a ring that encloses a rotation center of the drum 2. The flow path forming part 159 may include a pipe having one end (e.g., one end fixed to the fixed panel) enclosing the inlet 158 and the other end (e.g., one end contacting with the drum) enclosing the air inlet 233. In order to minimize an effect that vibration, which is generated when the drum 2 rotates, is transferred to the fixed panel 151, the flow path forming part 159 may be formed of a substance (e.g., rubber, etc.) having high elasticity.

A radius of a ring formed by the air inlet 233 (or an inner or outer diameter of the ring) may be set equal to or greater than ½ of a radius of the rear cover 23. Thus, the air moving into the drum through the air inlet 233 can move along a circumferential surface of the drum.

When the air inlet 233 is configured in the above manner, if the supply part 3 is controlled to supply air when the drum rotates at an rpm that induces a centrifugal force over 1G (when laundry is rotated while closely adhering to the circumferential surface of the drum), the laundry treating apparatus may reduce a drying time.

As shown in the drawing, the supply part 3 may include an exhaust duct connecting the first outlet 128 and the second outlet 157 to each other, a supply duct supplying external air (e.g., air inside the cabinet or air outside the cabinet) to the drum 2, and a heat exchange part heating the air flowing into the supply duct.

To sense a dryness degree of laundry placed within the drum 2, a sensing part 13 may be further included in the laundry treating apparatus 100. The sensing part 13 may be configured to measure a dryness degree via electric resistance measured when contacting with laundry, measure a dryness degree by measuring a temperature of air discharged from the drum 2, or measure a dryness degree by measuring a temperature of a refrigerant circulating along the refrigerant pipe 348.

FIG. 2 shows an example of a case that the sensing part 13 is configured to measure electrical resistance of laundry. The sensing part 13 shown in FIG. 2 may include first and second electrodes 131 and 133 fixed to the support panel 121. It is necessary for the first and second electrodes 131 and 133 to maintain a state of being spaced apart from each other while fixed to the support panel 121. The first and second electrodes 131 and 133 may be fixed in a space located under a horizontal line, which passes through a center of the entrance 111, in a space provided by the support panel 121. In this case, if laundry is placed under the horizontal line passing through the rotation center of the drum 2 (e.g., if the laundry is located at the lowest point of the drum), the first and second electrodes 131 and 133 may be facilitated to contact with the laundry.

If a dryness degree of laundry is raised, an amount of moisture remaining in the laundry will be reduced. If the dryness degree increases, a size of current sensed by the sensing part 13 may decrease. Hence, a controller (not shown) may estimate a dryness degree of the laundry by monitoring a size of the current transmitted from the sensing part.

If a dryness degree of laundry is low, a temperature of air discharged from the drum 2 is low. If a dryness degree gets higher, a temperature of air discharged from the drum 2 becomes higher. Hence, the sensing part 13 may be configured to sense a temperature of air discharged from the drum. As shown in FIG. 1, the sensing part 13 may include a temperature sensor 135 (e.g., an air temperature detection sensor) provided to the exhaust duct 31.

Since a temperature of a refrigerant circulating a refrigerant pipe varies depending on a dryness degree of laundry, the sensing part 13 may include a temperature sensor measuring a temperature of a refrigerant moving along the refrigerant pipe (e.g., a temperature of a refrigerant moving from the heat absorbing part to the compressor, a temperature of a refrigerant moving from the compressor to the heating part, etc.). FIG. 1 shows an example of a case that the sensing part 13 includes the temperature sensor (a refrigerant temperature sensing sensor) 137 sensing a temperature of a refrigerant moving from the compressor 345 to the heating part 343.

The sensing part 13 may include at least two of a pair of electrodes 131 and 133 measuring electrical resistance of laundry, a temperature sensor 135 measuring a temperature of air discharged from the drum, and a temperature sensor 137 measuring a temperature of a refrigerant.

The drive part D may include a motor 5 located at the drive part installation recess 153 and a power transmission part 6 fixed to the fixed panel 151 to transmit power generated by the motor 5 to the drum 2.

To minimize an effect that the fixed panel 151 is deformed by the weight of the drive part D and the external force generated from operating the drive part D, a drive part bracket 4 providing a space for fixing at least one of the motor 5 and the power transmission part 6 thereto may be provided to the drive part installation recess 153. Namely, the power transmission part 6 may be fixed to the drive part bracket 4 and the motor 5 may be fixed to at least one of the power transmission part 6 and the drive part bracket 4. The drive part bracket 4 may include a metal (e.g., metal having solidity greater than that of the fixed panel) in a ring shape fixed to the drive part installation recess 153.

Figure 3:
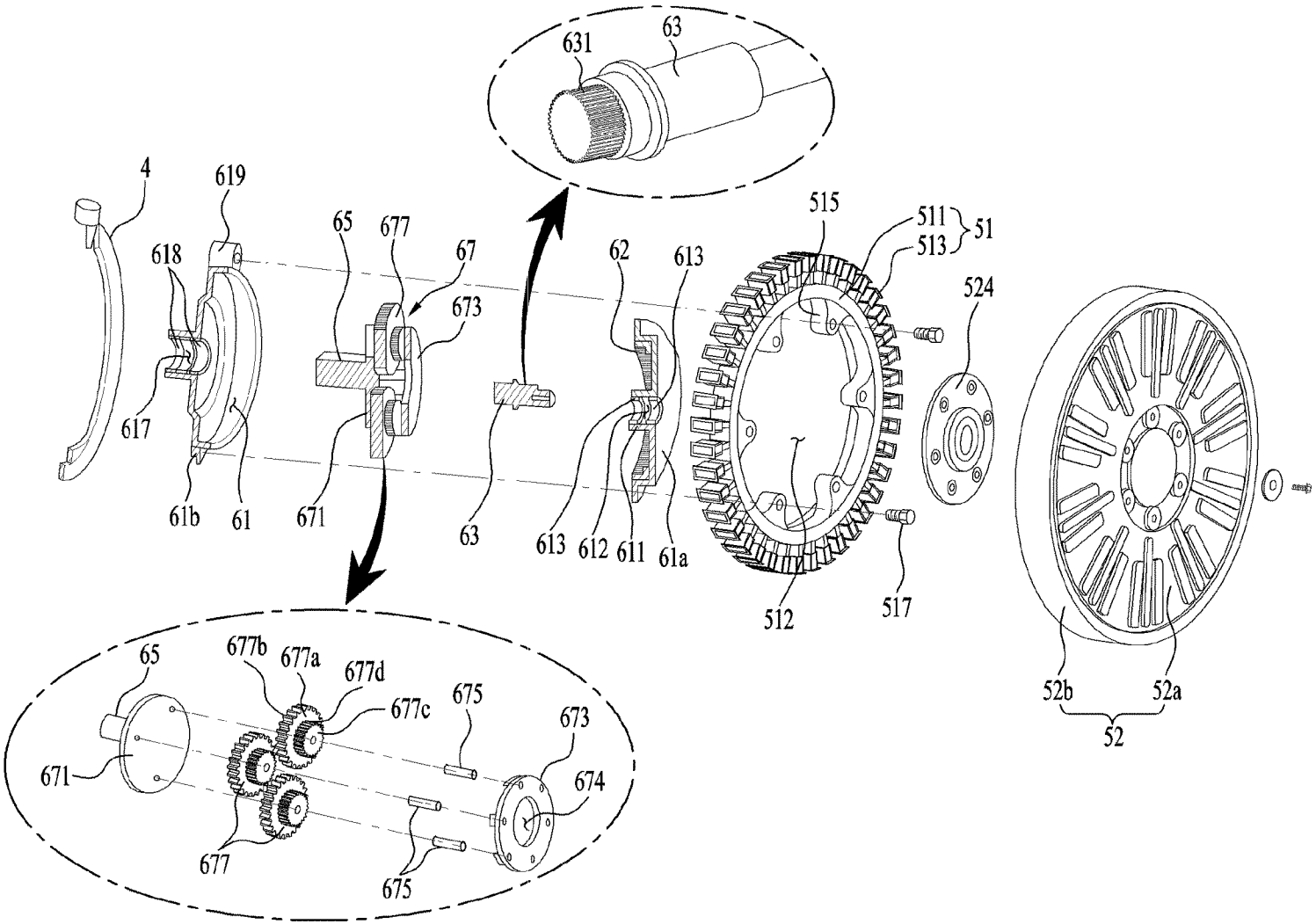
FIG. 3 is a diagram showing one example of a drive part.

As shown in FIG. 3, the motor 5 may include a stator 51 forming a rotating field and a rotor 52 rotated by the rotating field.

The stator 51 may include a core 511 fixed to the drive part bracket 4 or the power transmission part 6, a core perforated hole 512 provided to perforate the core, and an electromagnet (e.g., coil) 513 disposed on a circumferential surface of the core 511 in a manner of being equally spaced.

The rotor 52 may include a rotor body **52*a* in a disk shape, a rotor circumferential surface 52*b* in a pipe shape fixed to the rotor body, and a multitude of permeant magnets 525 fixed to the rotor circumferential surface. The permanent magnets 525 are fixed to the rotor circumferential surface 52*b*** in a manner that N poles and S poles are alternately exposed.

The power transmission part 6 may include a housing 61 in a hollow cylindrical shape fixed to the fixed panel 151, a ring gear 62 fixed to an inside of the housing, a first shaft (i.e., an input shaft) 63 having one end fixed to the rotor body **52*a* and the other end located within the housing 61, a driver gear 631 located within the housing 61 by being fixed to the first shaft 63, a driven gear 677 connecting the driver gear 631 and the ring gear 62 together, a cage 67 rotated within the housing 61 by the driven gear, and a second shaft 65 having one end fixed to the rear cover 23 and the other end fixed to the cage 67**.

To minimize the risk of deformation of the rotor body **52*a* by the first shaft 63, the first shaft 63 may be fixed to the rotor body 52*a* via a fixed plate 524**.

The second shaft 65 may be preferably configured to form a concentric axis with the first shaft 63. If the second shaft 65 and the first shaft 63 are configured to form the concentric axis, vibration generated from the power transmission part 6 may be minimized when the drum 2 rotates.

The housing 61 is preferably configured to be located in the core perforated hole 512 by being fixed to the fixed panel 151 via the drive part bracket 4. This is to minimize the volume of the drive part D in a manner that the housing 61 is placed within the core perforated hole 512.

The housing 61 may include a first housing **61*a* in a cylindrical shape having an open side facing the fixed panel 151 and a second housing 61*b* in a cylindrical shape having an open side facing the first housing so as to close the open side of the first housing by being coupled to the first housing 61***a*.

A first shaft support part 611 and a first shaft perforated hole 612 perforating the first shaft support part 611 may be provided to the first housing 61*a*. The first shaft 63 penetrates the first housing 61*a* by being inserted in the first shaft perforated hole 612, and a first shaft bearing 613 rotatably fixing the first shaft 63 to the first housing 61*a* may be provided to the first shaft support part 611.

Figure 4:
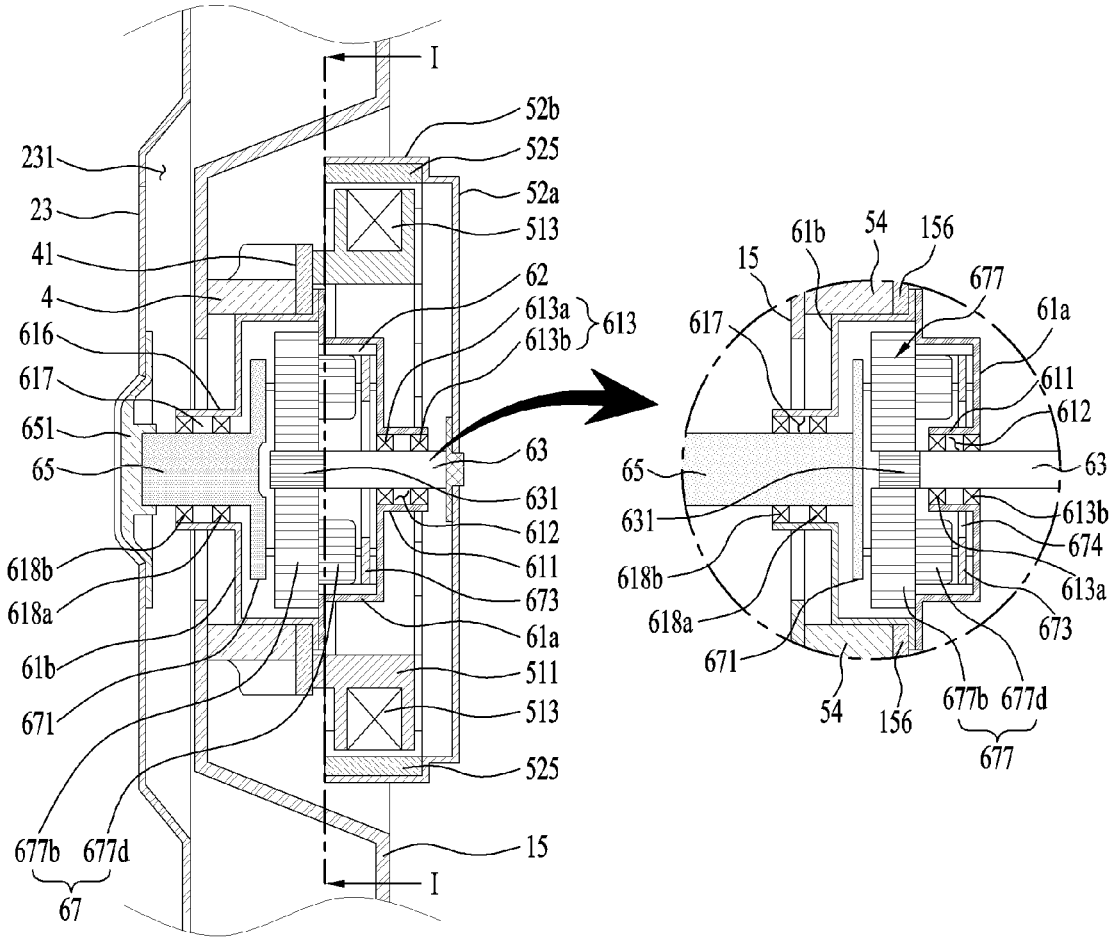
FIGS. 4 to 6 and FIGS. 9A and 9B are diagrams showing embodiments of a power transmission part.

As shown in FIG. 4, the first shaft support part 611 may include a pipe protruding from the first housing 61*a* toward the rotor body 52*a* or a pipe protruding from the first housing 61*a* toward the second housing 61*b*.

If the first shaft support part 611 includes the pipe protruding from the first housing 61*a* toward the second housing 61*b* (e.g., a pipe protruding from the first housing toward a center of the housing), it brings an effect of minimizing the volume of the housing 61 (i.e., an effect of minimizing a volume of the drive part, an effect of minimizing a volume of the laundry treating apparatus).

A second shaft support part 616 and a second shaft perforated hole 617 perforating the second shaft support part 616 may be provided to the second housing 61*b*. The second shaft 65 penetrates the second housing 61*b* through the second shaft perforated hole 617, and a second shaft bearing 618 rotatably fixing the second shaft 65 to the second housing 61*b* may be provided to the second shaft support part 616.

The second shaft support part 616 may include a pipe protruding from the second housing 61*b* toward the fixed panel perforated hole 155 (e.g., a pipe protruding toward the rear cover of the drum).

The first shaft bearing 613 may include a first shaft first bearing 613*a* and a first shaft second baring 613*b*, and the second shaft bearing 618 may include a second shaft first bearing 618*a* and a second shaft second bearing 618*b* provided along a length direction of the second shaft 65.

If the first shaft bearing includes two or more bearings 613*a* and 613*b* and the second shaft bearing includes two or more bearings 618*a* and 618*b*, when the rotor 52 rotates, it is able to minimize an effect that the first shaft 63 and the second shaft 65 become eccentric (vibration generated from the drive part can be minimized).

Since several bearings need to be disposed along a rotating shaft, a volume of the drive part D provided with a multitude of bearings increases inevitably. Hence, it is difficult to design a rotation shaft to be supported by a multitude of bearings in the laundry treating apparatus 100 having the cabinet 1 in the limited volume. However, in the above-described laundry treating apparatus 100, the volume of the drive part can be minimized via the structure that the housing 61 is located in the core perforated hole of the stator, the pipe structure that the first shaft support part 611 protrudes toward the center of the housing and the like, whereby the number of the bearings 613 and 618 can be increased.

To minimize the volume of the housing 61, a diameter of the first housing 61*a* may be set different from that of the second housing 61*b*. Namely, the diameter of the first housing 61*a* may be set smaller or greater than that of the second housing 61*b*.

The ring gear 62 may include a ring gear body, a ring gear body perforated hole configured to perforate the ring gear body, and gear teeth provided along an inner circumferential surface of the ring gear body (e.g., a circumferential surface forming the ring gear body perforated hole).

The ring gear 62 may be fixed to either the first housing 61*a* or the second housing 61*b*, of which diameter is smaller. As shown in the drawing, if the diameter of the first housing 61*a* is set smaller than that of the second housing 61*b*, the ring gear 62 may be fixed to the circumferential surface of the first housing 61*a*.

As shown in FIG. 3, the cage 67 may include a base 671 located in the housing 61, a connecting shaft rotatably fixing the driven gear 677 to the base 671, and a base cover 673 in a ring shape fixed to one end of the connecting shaft 675.

The second shaft 65 may be configured to connect the base 671 and the rear cover 23 of the drum together by being inserted in the fixed panel perforated hole 155. To prevent the breakage of the rear cover 23 due to the rotation of the second shaft 65, a shaft bracket 651 having one end of the second shaft 65 fixed thereto may be provided to the rear cover 23.

As shown in FIG. 2, to minimize an effect that a volume of the drum is increased by the shaft bracket 651, a shaft bracket installation recess 231 having the shaft bracket 651 fixed thereto may be provided to the rear cover 23. The shaft bracket installation recess 231 may be configured in a manner that the rear cover 23 is bent toward a direction of getting far away from the fixed panel 151. Preferably, the shaft bracket installation recess 231 is located at the same position of the drive part installation recess 153 and a diameter of the shaft bracket installation recess 231 is set greater than that of the drive part installation recess 153. This is to minimize the risk that the rear cover 23 may collide with the drive part installation recess 153 when the drum 2 rotates.

The driven gear 677 may include a multitude of gears spaced apart from each other at the same angle. FIG. 3 shows an example of a case that the driven gear 677 and the connecting shaft 675 are configured with three gears spaced apart from each other at 120 degrees and three shafts spaced apart from each other at 120 degrees.

Each of the driven gears 677 may include a first body 677*a* rotatably fixed to the base 6761 via the connecting shaft 675, a first gear 677*b* provided to a circumferential surface of the first body 677*a* to engage with the driver gear 631, a second body 677*c* fixed to the first body 677*a* with a diameter smaller than that of the first body, and a second gear 677*d* provided to a circumferential surface of the second body 677*c* to engage with the ring gear 62.

As shown in FIG. 4, the driver gear 631 fixed to a free end of the first shaft 63 may be located in a space formed between the driven gears so as to be connected to each of the first gears 677*b*. A free end of the first shaft support part 611 may penetrate the base cover 673 by being inserted in a base cover perforated hole 674 formed at a center of the base cover 673. Such a structure (i.e., the structure of the first shaft support part and the base cover) is characterized in minimizing the volume of the housing (i.e., volume minimization of the drive part).

To seal the fixed panel perforated hole 155 (i.e., to prevent air supplied to the drum from leaking from the cabinet), a sealing part 41 may be further provided to the drive part bracket 4 or the fixed panel 151. If the drive part bracket 4 is configured in a ring shape enclosing the fixed panel perforated hole 155 and the housing 61 is fixed to the drive part bracket 4 to be located in the core perforated hole 512, the sealing part 41 may be configured to seal a space formed between the drive part bracket 4 and the second housing 61*b*.

Figure 5:
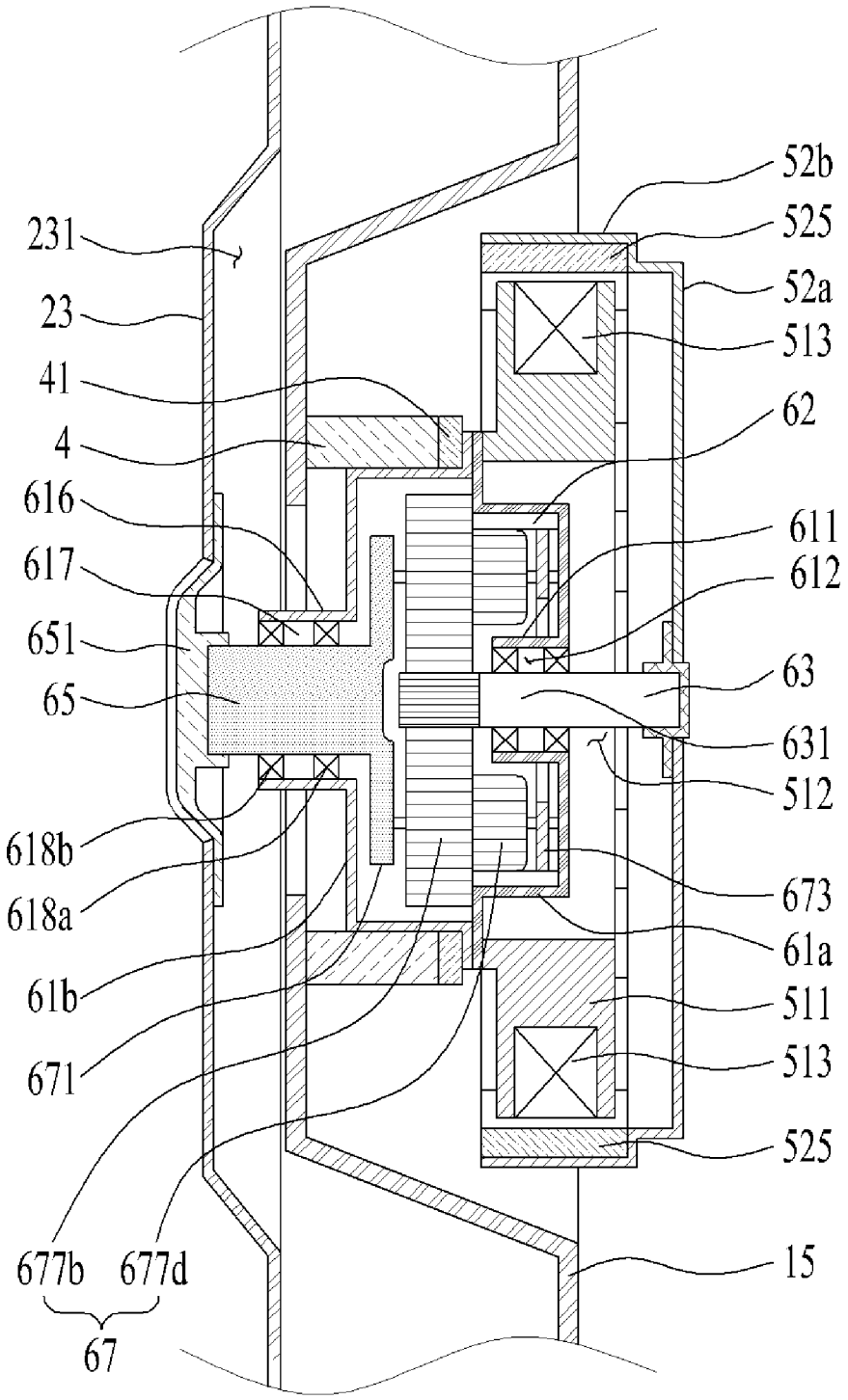

The drive part D shown in FIG. 5 has the same structure of the drive part D shown in FIG. 4 except that the stator 51 is fixed to the housing 61. Namely, the drive part D shown in FIG. 4 has the stator 51 fixed to the fixed panel 151 via the drive part bracket 4, while the drive part D shown in FIG. 5 has the stator 51 fixed to the fixed panel 151 via the housing 61 of the power transmission part.

As shown in FIG. 3, if the stator 51 is fixed to the housing 61, a core bracket 515 may be provided to the core 511 and a core installation part 619 may be provided to the housing 61. The core 511 may be fixed to the housing 61 via a core fastening part 517 fixing the core bracket 515 to the core installation part 619. The core installation part 619 may include a projection projected toward a direction of getting far away from a circumferential surface of the second housing 61*b* along a diameter direction of the second housing 61*b*.

Figure 6:
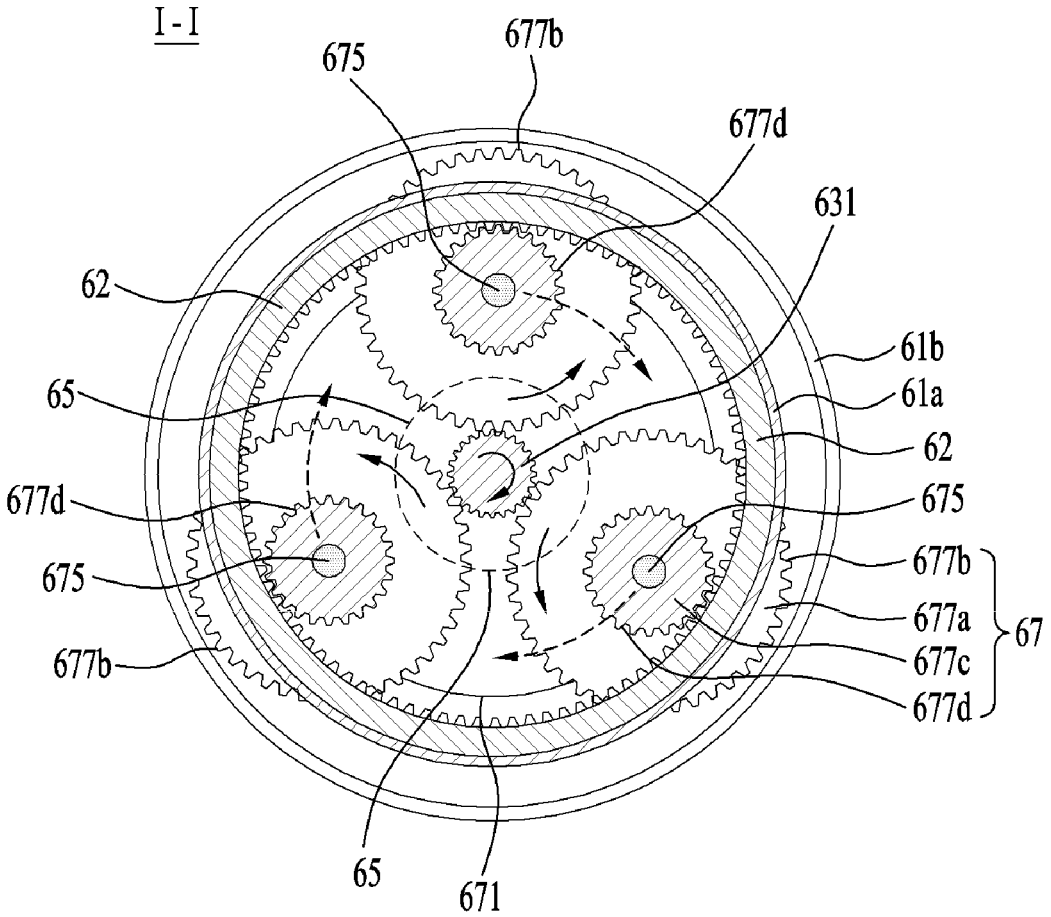

An operating process of the above-configured drive part D is described as follows. As shown in FIG. 6, if the rotor 52 rotates clockwise, the first shaft 63 and the driver gear 631 will rotate clockwise as well.

If the driver gear 631 rotates clockwise, the driven gears 677 will be rotated counterclockwise by the first gears 677*b*, respectively. If the first gear 677*b* rotates counterclockwise, the second gear 677*d* rotates counterclockwise as well. Since the ring gear 62 is fixed to the fixed panel 15, if the second gear 677*d* rotates counterclockwise, the base 671 and the second shaft 65 will rotate clockwise. As the drum 2 and the base 671 are connected together via the second shaft 65, the drum 2 will rotate in the same direction of the rotor 52.

If the stator 51 is fixed to the housing 61, it is advantageous in maintaining concentricity of the first and second shafts 63 and 65 and the space between the stator and the rotor. Assume a case that the stator 51 is fixed not to the housing 61 but to the fixed panel 151. In this case, vibration of the drum and vibration of the fixed panel 151 will be transferred to the second shaft 65 and the vibration of the fixed panel 151 will be transferred to the first shaft 63. If the vibration of the drum 2 and the vibration of the fixed panel 151 differ from each other in amplitude, it may be difficult to maintain the desired levels of the space and concentricity of the first and second shafts and the desired level of a space between the coil 513 of the stator and the permanent magnet 525 of the rotor. Yet, if the stator 51 is fixed to the housing 61, the same vibration is transferred to each of the first and second shafts externally, thereby solving the aforementioned problem.

As shown in the drawing, a diameter of the first gear 677*b* may be set greater than that of the driver gear 631. A diameter of the second gear 677*d* may be set greater than that of the driver gear 631 and smaller than that of the first gear 677*b*. The diameter of the second gear 677*d* may be set equal to that of the driver gear 631 [not shown in the drawing].

If the first gear, the second gear and the driver gear are provided as described above, the drive part D may rotate the drum 2 at an rpm lower than that of the rotor 52. Namely, the drive part D may play a role as a decelerator.

Figure 7:
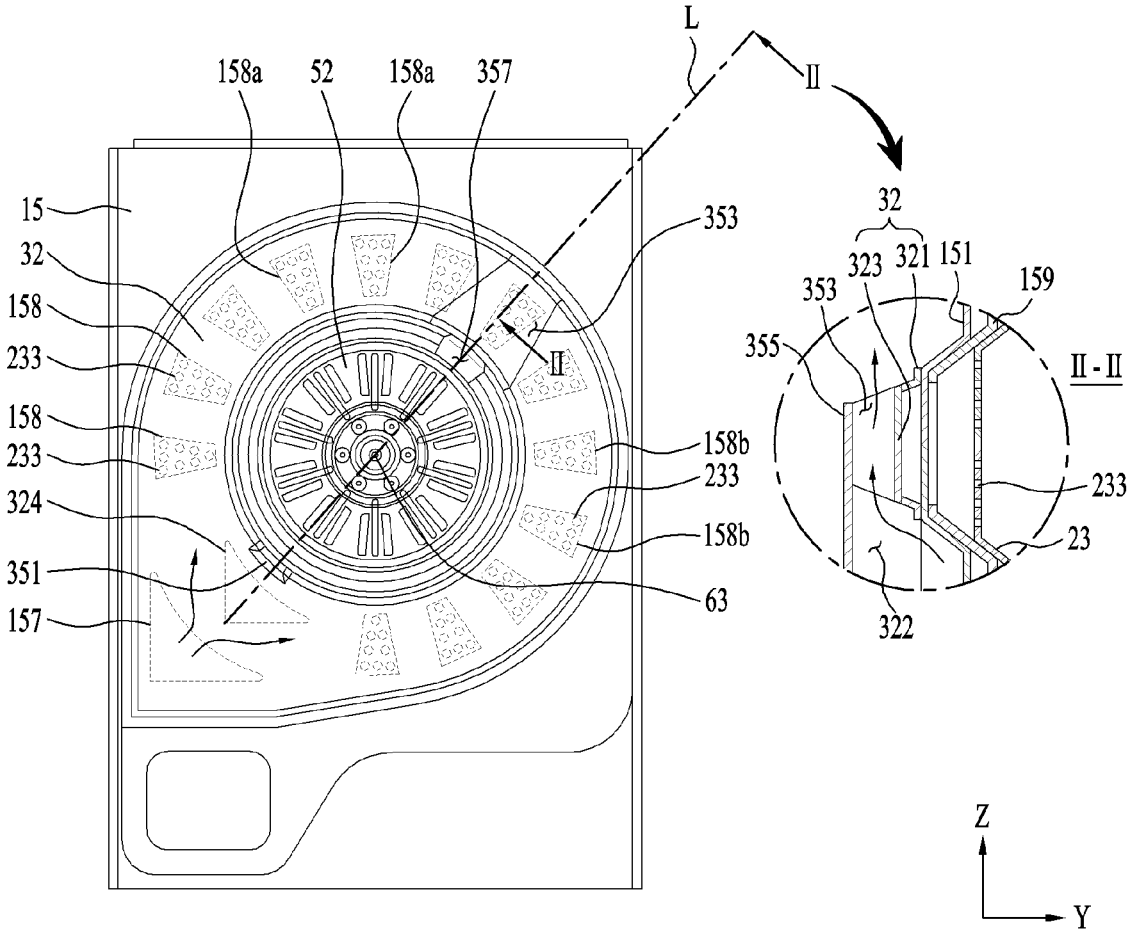
FIG. 7 is a diagram showing one example of a supply part.

As described above, a multitude of the perforated holes 158*a* and 158*b* disposed in a ring shape are provided to the rear cover 23 of the drum. As shown in FIG. 7, a flow path guide 324 supplying air discharged from the second outlet 157 to the perforated holes evenly may be further provided to the laundry treating apparatus 100.

As air moves to a side of small flow path resistance, if the laundry treating apparatus 100 fails to include the flow path guide 324, regarding the air having flown into the duct body 321 through the second outlet 157, an amount of the air moving inside the duct body 321 clockwise tends to differ from an amount of the air moving inside the duct body 321 counterclockwise. For example, if the amount of the air moving inside the duct body 321 clockwise is greater than that of the air moving inside the duct body 321 counterclockwise, more air is supplied to the perforated holes 158*a* located on a left side of a reference line L but less air is supplied to the perforated holes 158*b* located on a right side of the reference line L.

The unbalance of the aforementioned air supply amount may cause the unbalance of air supplied to laundry within the drum 2. Namely, if an amount of the supplied air varies depending on a location of laundry, it may cause a problem of an increased drying time and a problem of an over-dried state of one laundry or an undried state of another laundry.

If the amount of the air moving inside the duct body 321 clockwise is maintained equal or similar to that of the air moving inside the duct body 321 counterclockwise, the above problems can be solved.

The flow path guide 324 may be configured in a shape including a first incline guiding some of air discharged from the second outlet 157 to the left side of the reference line L and a second incline guiding the rest of the air to the right side of the reference line L. Therefore, by the flow path guide 324, some of the air flowing into the duct body 321 will move to the perforated holes 158*a* located on the left side of the reference line L and the rest will move to the perforated holes 158*a* located on the right side of the reference line L.

The reference line L may be set as a straight line passing through a center of the rotor receiving part 322 and a center of the second outlet 157. Unlike the drawing, the reference line L may be set as a straight line passing through one point in the rotor receiving part 322 and one point in the second outlet 157.

Furthermore, a projected wall 323 partitioning an inside of the duct body 321 into two spaces may be further provided to the supply duct 32. The projected wall 323 may include a projection projected from the duct body 321 toward the fixed panel 151 or a projection projected from the fixed panel 151 toward the duct body 321. FIG. 7 shows a case that the projected wall 323 is projected from the duct body 321 toward the fixed panel 151.

A free end of the projected wall 323 may be configured to contact with the fixed panel 151 or not to contract with the fixed panel 151. FIG. 7 shows a case that the free end of the projected wall 323 fails to contract with the fixed panel 151.

Preferably, the projected wall 323 is located at a position that makes the number of the perforated holes 158*a* located on the left side of the reference line L equal to the number of the perforated holes 158*a* located on the right side of the reference line L. If the reference line L is set to bisect the number of the perforated holes, the projected wall 323 will be configured to be located on the reference line L.

Regarding the above-configured laundry treating apparatus 100, since the duct body 321 is configured to enclose the motor 5 (since the motor is located inside the rotor receiving part), it is possible for the motor 5 to overheat.

Figure 8:
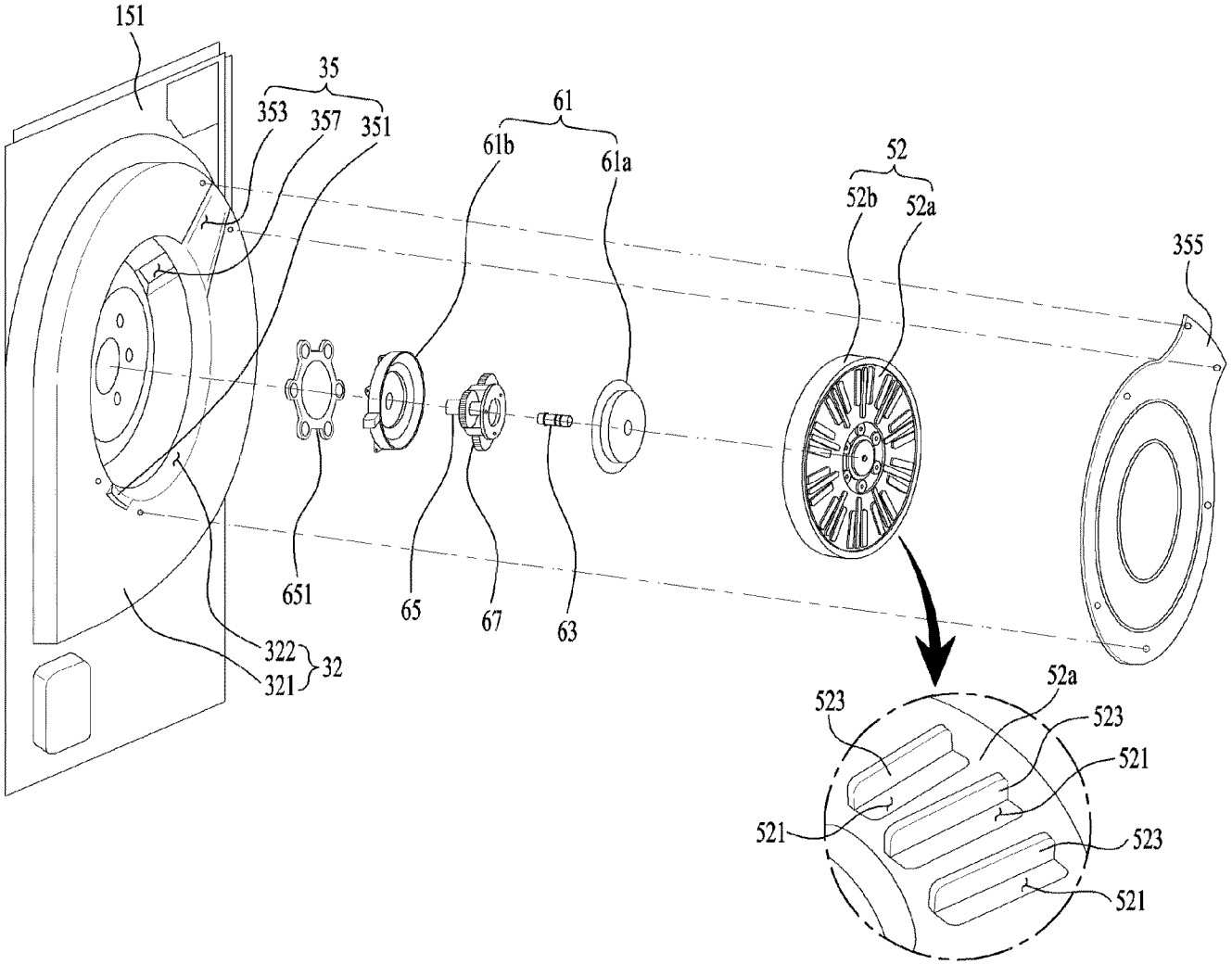
FIG. 8 is a diagram showing one example of a cooling flow path.

For the effective cooling of the motor 5 (e.g., for the cooling of the stator), a cooling flow path 35 may be further provided to the laundry treating apparatus 100. As shown in FIG. 8, the cooling flow path 35 may include a duct cover 355 fixed to the duct body 321 to close the rotor receiving part 322, an inlet flow path 351 provided to the duct body 321 to supply external air to the rotor receiving part 322, and an outlet flow path 353 provided to the duct body 321 to guide the air in the rotor receiving part 322 to an outside of the rotor receiving part 322.

Each of the inlet flow path 351 and the outlet flow path 353 may be configured as a recess formed in a manner that a top side of the duct body 321 is concavely bent. If the outlet flow path 353 is configured as the recess formed in a manner that the top side of the duct body 321 is bent toward the fixed panel 151, the projected wall 323 may be formed by a prescribed portion of the duct body 321 projected toward the fixed panel 151 to form the outlet flow path 353.

When the rotor 52 rotates, external air will flow into the rotor receiving part 322 through the inlet flow path 351 and the air in the rotor receiving part 322 may be discharged from the rotor receiving part 322 through the outlet flow path 353.

To facilitate the air flowing into the inlet flow path 351 to be discharged through the outlet flow path 353 (i.e., to facilitate the effective cooling of the motor), a vane 523 may be further provided to the rotor 52. The vane 523 may include a board projected from the rotor body 52*a* toward the duct cover 355.

The vane 523 may include a single board or a multitude of boards. In any cases, the vane 523 is preferably configured parallel to a diameter direction of the rotor body 52*a*. If the vane 523 includes the board parallel to the diameter direction of the rotor body, it may play a role as an impeller that forces air to move.

In order that heat generated from the stator 51 can be discharged to the rotor receiving part 322 more effectively, the rotor 52 may further include a rotor perforated hole 521 configured to perforate the rotor body 52*a*. The rotor perforated hole 521 may be configured in a manner that a multitude of holes are disposed to form a ring that encloses the first shaft 63.

The rotor perforated hole 521 may be configured as a slit, of which length for a diameter direction of the rotor body 52*a* is greater than a length for a circumferential direction of the rotor body 52*a*. In this case, the vane 523 may be fixed to an edge of the rotor perforated hole 521 parallel to the diameter direction of the rotor body 52*a*.

To facilitate the heat, which is generated from the stator 51, to be discharged to the rotor receiving part 322, a guide flow path 357 may be further provided to the drive part installation recess 153. The guide flow path 357 is a means for guiding the air in the drive part installation recess 153 to the outlet flow path 353.

To progress the cooling of the motor 5 more effectively, the inlet flow path 351, the rotation center of the rotor 52 and the outlet flow path 353 may be disposed on a single straight line. FIG. 7 shows an example of a case that the inlet flow path 351, the rotation center of the rotor 52, the guide flow path 357 and the outlet flow path 353 are disposed on the reference line L.

The power transmission part 6 shown in FIG. 4 and FIG. 5 may be provided with a structure in which the kinetic energy of the rotor 52 moves sequentially in the direction in which the rotor 52 is located toward a direction in which the drum 2 is located (i.e., a structure in which kinetic energy is transmitted a forward direction) or a structure in which the kinetic energy of the rotor 52 moves forward, backward and forward toward the drum located direction from the rotor located direction (i.e., a structure including a process for transmitting kinetic energy in a reverse direction).

Figure 9B:
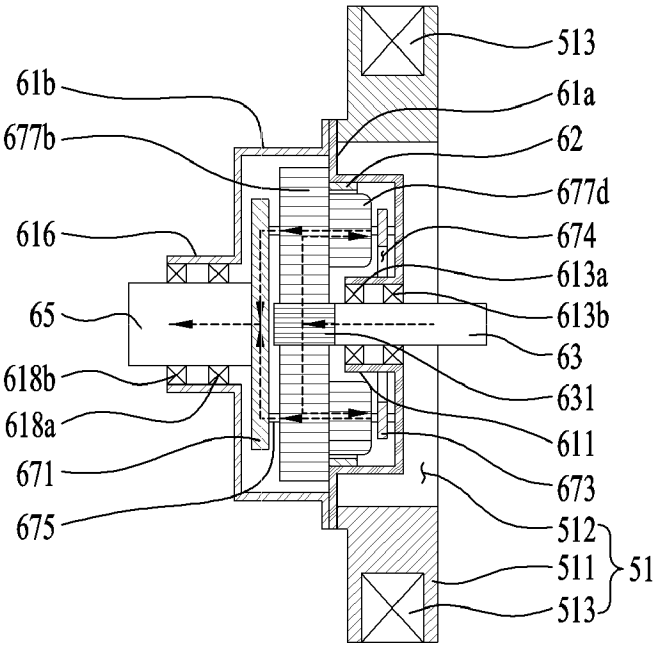
Figure 9A:
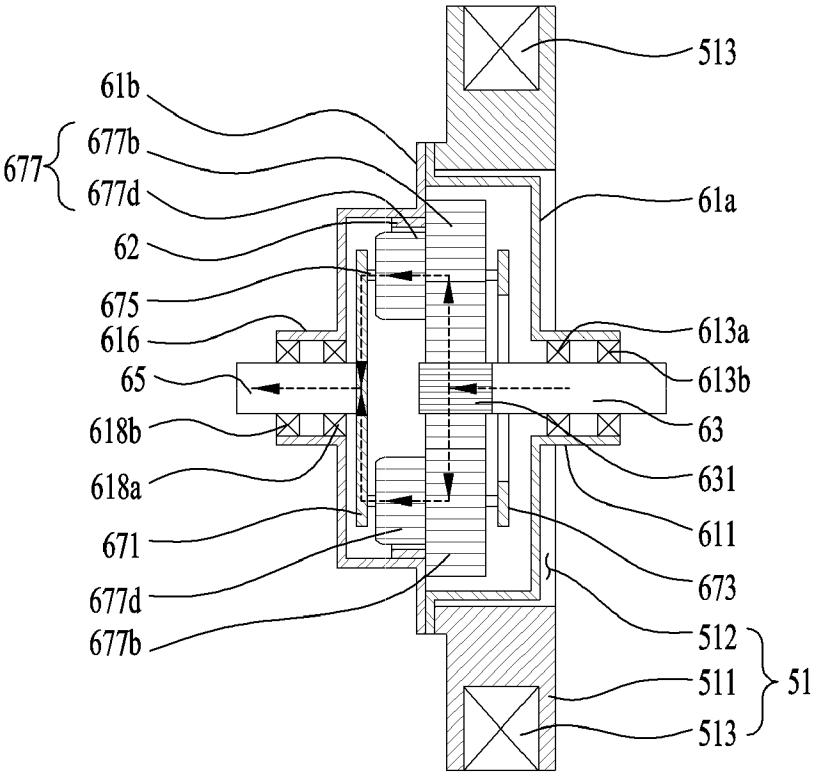

FIG. 9 (*a*) shows an example of a power transmission part in a structure that kinetic energy of a rotor is transmitted in a forward direction. FIG. 9 (*b*) shows an example of a power transmission part in a structure that kinetic energy of a rotor is transmitted along a forward direction, a backward direction and a forward direction.

The driven gear 677 in FIG. 9 (*a*) may include the first body 677*a* rotatably fixed to the base 671, the first gear 677*b* provided to the circumferential surface of the first body 677*a* to engage with the driver gear 631, the second body 677*c* protruding from the first body 677*a* toward a direction having the drum 2 located therein, and the second gear 677*d* provided to the circumferential surface of the second body to engage with the ring gear 62. In this case, the first gear 677*b* may be located between the first housing 61*a* and the ring gear 62, and the second gear 677*d* may be located between the first gear 677*b* and one side of the second housing 61*b*. The drawing shows an example that the first gear 677*b* is located in the space provided by the first housing 61*a* and that the second gear 677*d* is located in the space provided by the second housing 61*b*.

Regarding the power transmission part shown in FIG. 9 (*a*), the kinetic energy of the rotor 52 is transmitted as the kinetic energy of the driver gear 631 by the first shaft 63, the kinetic energy of the driver gear 631 is transmitted to the first gear 677*b* and the second gear 677*d*, the kinetic energy of the second gear 677*d* is transmitted to the base 671 and the second shaft 65. Since the above-described transmission of the kinetic energy is performed sequentially from the rotor 52 toward the drum 2, FIG. 9 (*a*) may be defined as the forward power transmission structure.

On the other hand, the driven gear 677 in FIG. 9 (*b*) may include the first body 677*a* rotatably fixed to the base 671, the first gear 677*b* provided to the circumferential surface of the first body 677*a* to engage with the driver gear 631, the second body 677*c* protruding from the first body 677*a* toward a direction having the rotor 52 located therein, and the second gear 677*d* provided to the circumferential surface of the second body to engage with the ring gear 62. In this case, the first gear 677*b* may be located between the base 671 and the ring gear 62, and the second gear 677*d* may be located between the first gear 677*b* and one side of the first housing 61*a*. The drawing shows an example that the first gear 677*b* is located in the space provided by the second housing 61*b* and that the second gear 677*d* is located in the space provided by the first housing 61*a*.

Regarding the power transmission part shown in FIG. 9 (*b*), the kinetic energy of the rotor 52 is transmitted as the kinetic energy of the driver gear 631 by the first shaft 63, and the kinetic energy of the driver gear 631 is transmitted to the first gear 677*b* [forward transmission of kinetic energy]. The kinetic energy of the first gear 677*b* is transmitted to the second gear 677*d* that is provided not in the drum located direction but in the rotor located direction. Therefore, the kinetic energy of the first gear 677*b* is transmitted in the backward direction. Thereafter, the kinetic energy of the second gear 677*d* is transmitted to the second shaft 65 via the base 671. Since the base 671 is located between the first gear 677*b* and the second housing 61*b*, the kinetic energy of the second gear 677*d* is transmitted to the second shaft 65 along the forward direction.

In the power transmission part of FIG. 9 (*a*), the second body 677*c* is provided as a cylinder protruding from the first body 677*a* toward the second housing 61*b*. On the other hand, in the power transmission part of FIG. 9 (*b*), the second body 677*c* is provided as a cylinder protruding from the first body 677*a* toward the first housing 61*a*. Thus, since the driven gears 677 of FIG. 9 (*b*) can form a space, in which the free end of the first shaft support part 611 will be inserted, between the second gears 677*d*, the volume of the power transmission part 6 of FIG. 9 (*b*) may be configured smaller than that of the power transmission part of FIG. 9 (*b*).

Furthermore, in case of FIG. 9 (*b*), if at least one of a multitude of the bearings 613*a* and 613*b* configuring the first shaft bearing 613 is provided to the first shaft perforated hole 612 so as to be located in the space formed by the second gears 677*d*, the volume of the power transmission part 6 will be further reduced.

In some implementations, to minimize the volume of the power transmission part D, the power transmission part 6 shown in FIG. 9 (*a*) or FIG. 9 (*b*) may be configured in a manner that at least one area of the first housing 61*a* is inserted in the core perforated hole 512.

As shown in FIG. 1, in the above-configured laundry treating apparatus 100, although the rear cover 23 of the drum maintains a state of being coupled to the fixed panel 15 via the drive part D, the front cover 22 of the drum maintains a state of contacting with the drum connecting body 123 of the support panel via the connecting damper 124. Hence, if the drum 2 is moved toward the rear side (in the X-axis direction) of the laundry treating apparatus, it is possible for the front cover 22 to be separated from the drum connecting body 123.

If the front cover 22 is separated from the drum connecting body 123, the drum entrance 221 will be separated from the support panel perforated hole 122 (so that the air supplied to the drum will leak from the drum) to cause such problems as energy waste, drying time increase, reduced drying efficiency, etc.

If the front cover 22 is separated from the drum connecting body 123, laundry may be stuck in the space between the front cover and the drum connecting body, whereby heavy load may be put on the motor.

To solve the above problems, the laundry treating apparatus 100 may further include at least one of a front support part 7 and 8 supporting the front cover 22 and a rear support part 9 supporting the rear cover 23. FIG. 1 shows an example of the laundry treating apparatus 100 including both of the front support part 7 and 8 and the rear support part 9.

The front support part 7 and 8 may be configured to minimize an effect that the front cover 22 moves along a height direction (e.g., Z-axis direction) of the support panel 121 and a width direction (e.g., Y-axis direction) of the support panel, and the rear support part 9 may be configured to minimize an effect that the rear cover 23 moves along a direction (e.g., X-axis direction and Z-axis direction) of getting far away from the support panel 121.

Figure 10:
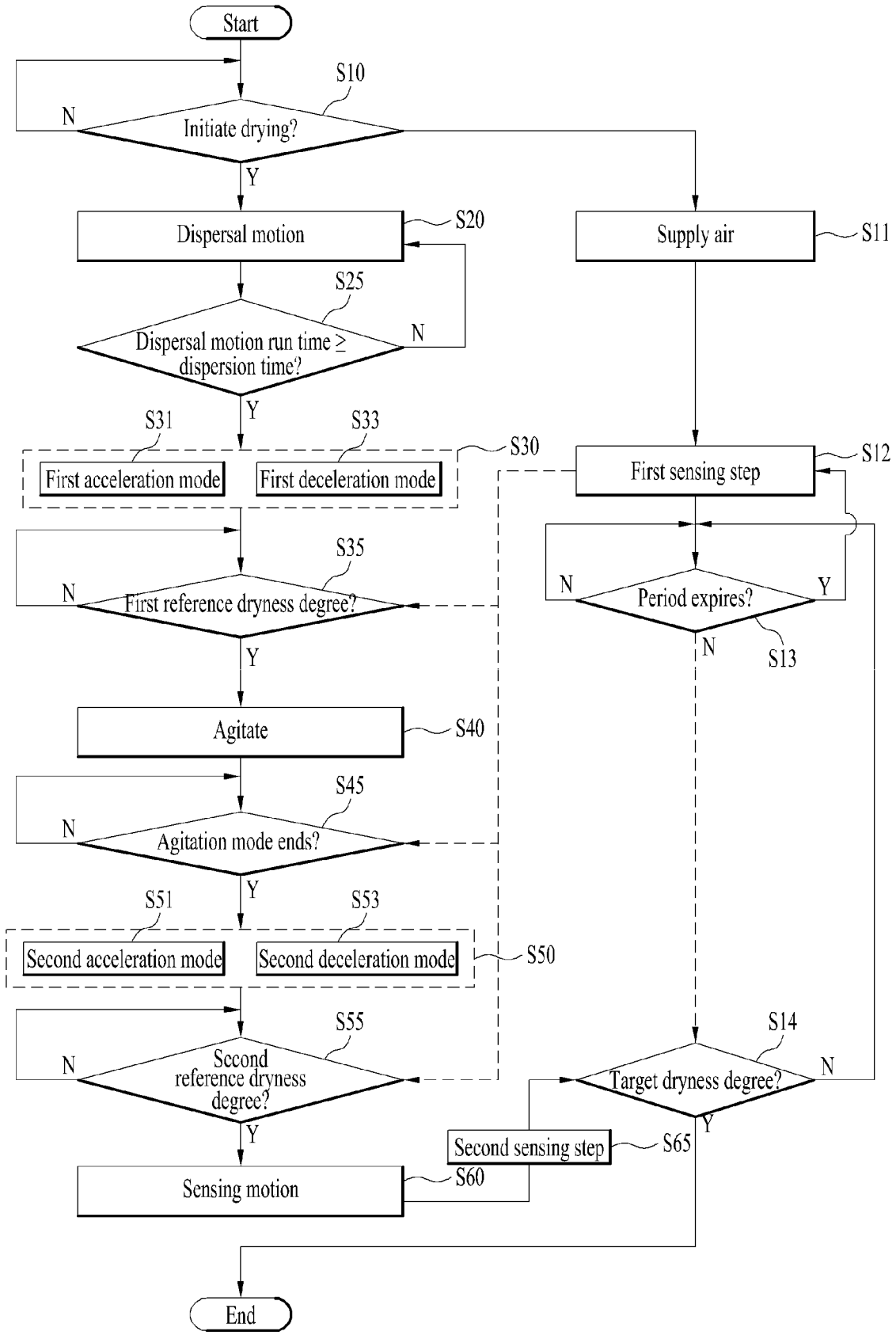
FIG. 10 shows one example of a method of controlling a laundry treating apparatus.

As shown in FIG. 10, the front support part may include a first front support part 7 supporting an area of a circumferential surface of the front cover 22 located under a horizontal line H passing through the rotation center of the drum and a second front support part 8 supporting an area of the circumferential surface of the front cover 22 located over the horizontal line H.

The first front support part 7 provided to at least one of the base panel 17 and the support panel 121 is a means for setting a range in which the drum entrance 221 can move along a width direction (+Y-axis direction, −Y-axis direction) of the support body 121 and a range in which the drum entrance 221 can move toward a direction (−Z-axis direction) having the base panel 17 located therein.

The first front support part 7 may include a first roller 71 rotatably fixed to the support panel 121 via a first roller shaft 711 and a second roller 73 rotatably fixed to the support panel 121 via a second roller shaft 731.

To minimize a load put on each of the roller shafts 711 and 731, positions of the first and second rollers 71 and 73 may be preferably set to points symmetric to each other with respect to a vertical line V passing through the rotation center of the drum.

In addition, to minimize an effect that vibration of the drum is transferred to the cabinet through the rollers 71 and 73, each of the rollers 71 and 73 may be configured to contact with the circumferential surface of the front cover when vibration over a preset reference displacement is generated from the drum (e.g., each of the rollers may be configured to maintain a state of being spaced apart from the front cover).

Figure 11A:
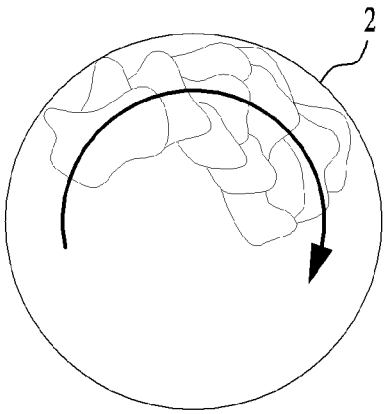
FIGS. 11A and 11B show examples of an acceleration mode and a deceleration mode, respectively.

The second front support part 8 provided to the support panel 121 is a means for setting a range in which the drum entrance 221 can move in a direction (+Z) of getting far away from the base panel 17. As shown in FIGS. 11A and 111B, the second front support part 8 may include a front support frame 81 located at a point higher than the front cover 22 by being fixed to the support panel 121 and a support damper 83 and 85 fixed to the front support frame 81 to put limitation on movement of the front cover 22 along a height direction of the support body 121.

To fix the front support frame 81, a support part installation recess bent concavely toward a direction in which the support panel 121 gets far away from the front cover 22 may be provided to the support panel 121, a slot 125 may be provided to the installation recess 125, and a fastening part 811 may be provided to the front support frame 81 so as to be inserted in the slot 125*a*.

Figure 12C:
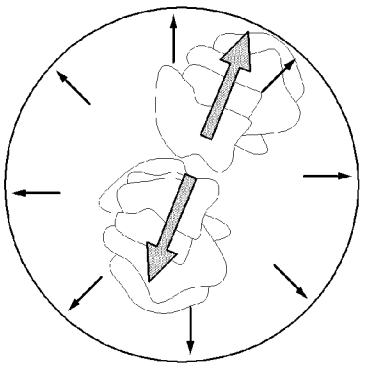
FIGS. 12A to 12C show a motion of laundry in a first motion executing step.
Figure 12B:
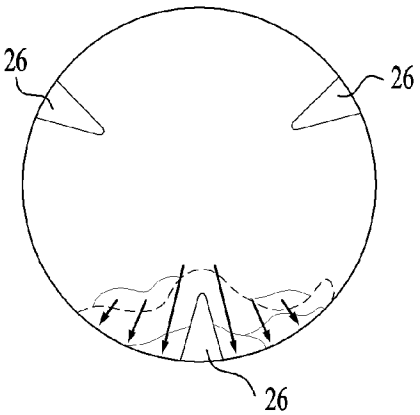
Figure 12A:
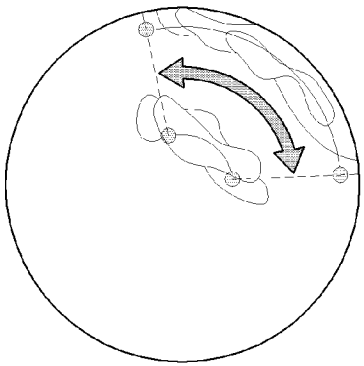

As shown in FIG. 12A, the support damper may include a first damper 83 fixed to the front support frame 81 and a second damper 85 fixed to the first damper 83 to support the circumferential surface of the front cover 22.

To enable to support damper 83 and 85 to effectively reduce the vibration of the drum 2, the first damper 83 may be formed of material having an elastic coefficient greater than that of the second damper 85. Namely, the second damper 85 may be provided with the same felt of the connecting damper 124, and the first damper 83 may be provided with rubber and the like.

As described above, the connecting damper 124 is fixed to the damper installation recess 123*a* provided in a ring shape to the free end of the drum connecting body 123 and may be configured to maintain a state pressurized in a direction of the support panel 121 by the front cover 22. This is to minimize an effect that the drum connecting body 123 and the edge of the drum entrance 221 are separated from each other.

FIG. 12B shows another embodiment of the second front support part 8. The second front support part 8 of the present embodiment may include a front roller 87 rotatably fixed to the front support frame 81 via a roller shaft 871 to support the circumferential surface of the front cover 22.

Unlike the drawing, the first front support part 7 may be configured not to support the circumferential surface of the front cover 22 but to support the circumferential surface of the drum body 21. In this case, each of the rollers 71 and 73 may be configured to support the area of the circumferential surface of the drum body 21 located under the horizontal line H. If each of the rollers 71 and 73 supports the circumferential surface of the drum body (or the circumferential surface of the front cover), it means to include both 'a case that each of the rollers 71 and 73 is configured to contact with the circumferential surface of the drum body' and 'a case that each of the rollers 71 and 73 is spaced apart to contact with the drum body when vibration over a reference displacement is generated from the drum'.

Likewise, the second front support part 8 may be configured to support an area of the circumferential surface of the drum body 21 located over the horizontal line H. Namely, the second damper 85 may be configured to support the area of the circumferential surface of the drum body 21 located over the horizontal line H and the front roller 87 may be configured to support the area of the circumferential surface of the drum body 21 located over the horizontal line H.

If the second damper 85 and the front roller 87 support the circumferential surface of the drum body (or the circumferential surface of the front cover), it means to include both 'a case that the second damper 85 or the front roller 87 is configured to contact with the circumferential surface of the drum body' and 'a case that the second damper 85 or the front roller 87 is spaced apart to contact with the drum body when vibration over a reference displacement is generated from the drum'.

As shown in FIG. 10, if a space between the first and second rollers 71 and 73 gets narrower (i.e., if each of the first and second rollers is disposed to get closer to the lowest point of the front cover), it becomes highly probable that the circumferential surface of the front cover 22 will deviate from a space formed by the first roller 71, the second roller 73 and the second front support part 8.

To prevent the load working on the shafts 711 and 731 of the rollers from rapidly increasing while stably supporting the circumferential surface of the front cover 22 (i.e., to improve durability of the roller shafts), an angle A3 formed between the vertical line V and a straight line connecting a rotation center 711/713 of each of the rollers to a rotation center C of the drum is preferably set smaller than 60 degrees. This is because if the angle A3 between the vertical line V and the straight line connecting the rotation center 711/731 of the roller and the rotation center C of the drum exceeds 60 degrees, an external force applied to the shaft 711/731 of the roller increase rapidly.

For example, the angle A3 of the roller shaft with respect to the vertical line may be set to 50 to 52 degrees and an angle A4 formed by a straight line connecting the shaft 711/731 of each of the rollers to the rotation center C of the drum with respect to a horizontal line connecting the shafts of the two rollers to each other may be set to 40 to 38 degrees.

Furthermore, an angle A1 between a line L1 connecting the rotation center 711 of the first roller to the center of the second front support part 8 and a line L2 connecting the rotation center 731 of the second roller to the center of the second front support part 8 may be set to 30 to 50 degrees. In this case, an angle A2 formed by a horizontal line L3 connecting the rotation centers 711 and 731 of the two rollers to each other and a straight line L1/L2 connecting the rotation center 711/731 of each of the rollers to the center of the second front support part 8 will form 65 to 75 degrees.

In some implementations, a gap G1 between a most upper end of each of the first and second rollers 71 and 73 and a most lower end of the circumferential surface of the front cover 22 may be preferably set greater than a gap G2 between the second front support part 8 and a most upper end of the circumferential surface of the front cover 22. Namely, a gap G3 between the roller's circumferential surface and the front cover's circumferential surface is preferably set smaller than the gap G2 between the second front support part 8 and the most upper end of the circumferential surface of the front cover.

Thus, when the drum vibrates, if the two rollers 71 and 73 can restrict the vibration of the drum earlier than the second front support part 8, it is able to minimize an effect that the rotation center of the drum vibrates along a width direction (i.e., Y-axis direction) of the support body 121. If the drum rotates while receiving laundry inside, vibration is generated from the drum. Regarding such vibration of the drum, vibration facing a direction (i.e., −Z-axis direction) in which a bottom end of the support body is located and vibration facing the width direction (i.e., Y-axis direction) of the support body are usually greater than vibration facing a direction (+Z-axis direction) in which a top end of the support body is located. Therefore, if the first front support part 7 and the second front support part 8 are configured as described above, vibration generated in the early stage of rotation of the drum may be effectively attenuated.

Figure 13A:
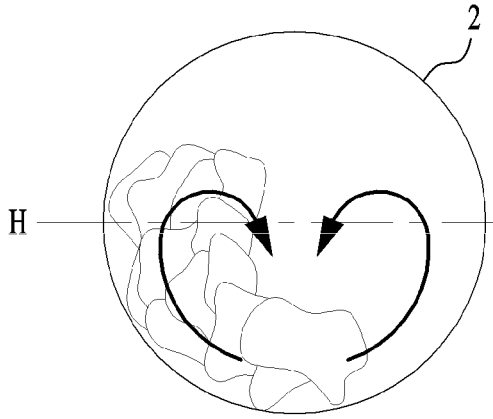
FIGS. 13A and 13B show examples of a dispersion mode and a sensing mode, respectively.
Figure 13B:
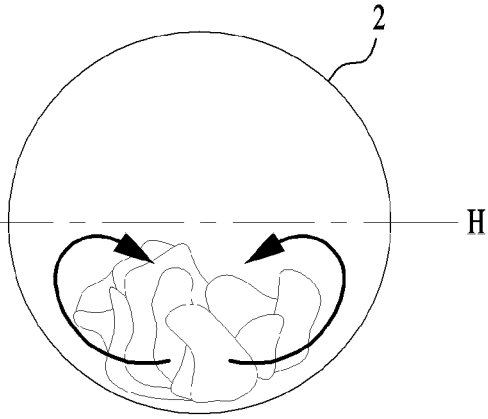

FIGS. 13A and 13B show an example of the rear support part 9. As described above, the rear support part 9 is a means for at least one of a range in which the rear cover 23 can move toward he fixed panel 151 and a range in which the rear cover 23 can move toward the base panel 17.

Although the rear support part 9 shown in FIGS. 13A and 13B is illustrated as fixed to the exhaust duct 31, the rear support part 9 may be fixed to the base panel 17, the fixed panel 12, or both of the base panel and the fixed panel. For clarity and convenience, the following description will be made based on a case that the rear support part 9 is fixed to the exhaust duct 31.

The rear support part 9 of FIG. 13A includes a rear support frame 91 fixed to the exhaust duct 31 and a seat part 93 provided to the rear support frame 91 to limit at least one of a backward displacement made by the rear cover 23 moving toward the fixed panel 151 and a downward displacement made by the rear cover 23 moving toward the base panel 17.

The seat part 93 may be configured to support a coupling surface of the rear cover 23. In this case, the seat part 93 is preferably configured to correspond to a shape of the coupling part 97 of the drum body 21 and the rear cover 23.

Namely, if the coupling part 97 of the drum body 21 and the rear cover 23 is formed by seaming (i.e., an assembly method of coupling the drum body and the rear cover together by folding one end of the drum body and an edge of the rear cover together), an L-shaped edge will be formed in the coupling part 97. The seat part 93 may include a first seat surface 931 fixed to the rear support frame 91 and extended along the height direction (+Z-axis direction) of the drum and a second seat surface extended from the rear support frame 91 toward a direction (-axis direction) having the support panel located therein. The first seat surface 931 may be configured to limit the backward displacement by being located in a space between a rear surface (i.e., a surface facing the fixed panel) of the coupling part 97 and the fixed panel 151, and the second seat surface 933 may be configured to limit the downward displacement by being located in a space between a bottom end of the coupling part 97 and the base panel 17.

The first seat surface 931 may be configured to maintain a state of contacting with the coupling part 97. Alternatively, the first seat surface 931 may be configured to contact with the coupling part 97 only if a displacement over a preset reference backward displacement occurs in the drum.

Likewise, the second seat surface 933 may be configured to maintain a state of contacting with the coupling part 97. Alternatively, the second seat surface 933 may be configured to contact with the coupling part 97 only if a displacement over a preset reference downward displacement occurs in the drum.

If the rear cover 23 and the seat part 93 are configured to contact with each other, the seat part 93 may include a felt to reduce a frictional force working on the drum (i.e., to reduce a load on the motor).

The rear support part 9 of FIG. 13B includes a rear support frame 91 fixed to the exhaust duct 31 and a rear roller 95 rotatably fixed to the rear support frame 91 to contact with the rear cover 23. The rear roller 95 is rotatably fixed to a free end of the rear support frame 91 via a roller shaft 951.

A roller receiving recess 235 providing a space, in which a portion of the rear roller 95 is inserted, may be further provided to the rear cover 23. The roller receiving recess 235 may include a recess configured in a manner that a surface of the rear cover 23 is bent toward the front cover 22. The roller receiving recess 235 may be configured to form a circle that encloses the center (i.e., the rotation center of the drum) of the rear cover 23.

The rear roller 95 may be configured to maintain a state of contacting with the rear cover 23. Alternatively, the rear roller 95 may be configured to contact with the rear cover 23 only if a displacement over a preset reference downward displacement occurs in the drum.

The front support part 7 and 8 and the rear support part 9 described above can minimize the effect that the drum entrance 221 moves in directions (e.g., −X-axis direction, +Z-axis direction, −Z-axis direction) of being separated from the drum connecting body. Hence, the laundry treating apparatus 100 can minimize the leakage of the air supplied to the drum and the problem of the laundry stuck between the drum and the support panel 121.

If the problem of the laundry stuck between the drum and the support panel can be minimized, it means that the load working on the drive part can be minimized, which means that the rpm and rotating direction of the drum can be controlled via the motor generating small torque.

Although the aforementioned laundry treating apparatus 100 is described based on a case of including a circulation-type drying system, it is applicable to an exhaust-type drying system. The circulation-type drying system means a drying system of sequentially executing dehumidification and heating of air discharged from the drum 2 and then resupplying hot and dry air to the drum. The exhaust-type drying system means a drying system of heating external air, supplying the heated air to the drum 2, performing heat exchange, and exhausting the air, which is discharged from the drum 2, to an outside of the cabinet 1.

In case that the laundry treating apparatus is configured as the exhaust-type drying system, the supply part 3 may include an exhaust duct connecting the first outlet 128 and the second outlet 157 to each other, a supply duct suppling external air (e.g., air in the cabinet or air outside the cabinet) to the drum 2, and a heat exchange part heating the air having flown into the supply duct.

FIG. 10 shows one example of a method of controlling a laundry treating apparatus. If power is supplied to the control panel 115, the above-described laundry treating apparatus 100 determines whether a control command requesting an execution of a drying course is inputted via the input unit 116 [S10].

If a control signal requesting a selection of the drying course and an execution of the selected drying course is inputted via the input unit 116, a control method according to the present embodiment executes an air supplying step S11. In the air supplying step S11, the fan 349 and the heat exchange part 34 are activated so as to remove moisture from laundry by supplying air at the temperature higher than a room temperature with humidity lower than indoor humidity (i.e., hot and dry air).

While the air supplying step S11 is being executed, the control method progresses a sensing step S12 (i.e., a first sensing step). The sensing step S12 may include a step of determining a dryness degree of laundry based on data measured by the sensing part 13.

The sensing step S12 may be configured to measure a dryness degree of laundry by every preset period [S13] or measure a dryness degree of laundry in real time in the course of the air supplying step S11.

The control method may progress a first motion executing step S30 in the course of the air supplying step S11. The first motion executing step S30 is a step of controlling the drum 2 to execute a first motion, and the first motion means an operation pattern of the drum that alternately executes an acceleration mode S31 (i.e., a first acceleration mode) and a deceleration mode S33 (i.e., a first deceleration mode). The air supplying step S11 and the first motion executing step S30 may be initiated simultaneously, or one of the two steps may be initiated earlier than the other.

As shown in FIG. 11A, the first acceleration mode S31 is a mode of rotating the drum at a first rpm. The first rpm may be set to an rpm for inducing a centrifugal force over 1G to laundry or an rpm for rotating the laundry in a manner of closely adhering to a circumferential surface of the drum. The drum 2 may be configured to be rotated in either clockwise or counterclockwise in the first acceleration mode S31. This is to minimize the load on the drive part D. The drawing shows one example of the first acceleration mode in which the drum 2 rotates clockwise.

As shown in FIG. 12A, in the course of the first acceleration mode S31, laundry is spread on the circumferential surface of the drum 2 and also maintains a state of adhering closely to the circumferential surface of the drum (i.e., the laundry maintains the state of adhering closely to the drum body). Namely, in the first acceleration mode S31, the laundry rotates together with the drum instead of falling within the drum. Therefore, if the first acceleration mode S31 is executed in the early stage of the drying process, the friction generated between the laundry and drum can be minimized when the laundry slips or falls within the drum, thereby minimizing a problem that the laundry is damaged by the frictional force in the early stage of the drying.

In addition, as shown in FIG. 12B, since the lifter 26 projected toward the rotation center of the drum 2 is provided to the drum 2, if the drum rotates in the first acceleration mode S31, the laundry may be pressurized toward the circumferential surface (i.e., the drum body) of the drum while caught on the lifter 26. Therefore, the control method may remove creases of laundry via the first motion executing step S30.

The air inlet 233 formed in the rear side of the drum may be configured in a manner that a multitude of the perforated holes are disposed in a ring shape that encloses the second shaft 65 forming the rotation center of the drum. As the air supplied to the drum through the air inlet 233 will move in a direction of the front side of the drum from the rear side of the drum along the circumferential surface of the drum, the first acceleration mode S31 may be expected to have an effect of maximizing the contact between the laundry and the air.

Figure 11B:
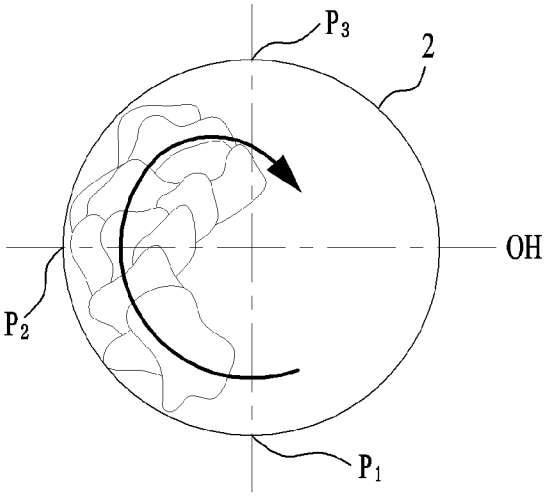

As shown in FIG. 111B, the first deceleration mode S33 is a mode for rotating the drum 2 at a second rpm set lower than the first rpm. The second rpm may be set to an rpm that induces a centrifugal force under 1G to the laundry. In the first deceleration mode S33, the drum 2 may be configured to rotate either clockwise or counterclockwise, and FIG. 11B shows one example of the first deceleration mode in which the drum 2 rotates clockwise.

In the first deceleration mode S33, the laundry will perform motions of being lifted up to a point higher than the horizontal line H passing through the rotation center of the drum 2 by the lifter 26, the centrifugal force, the frictional force and the like and then falling down to a lowest point of the drum 2. Namely, when the first deceleration mode S33 is in progress, the laundry will perform a motion of ascending from a lowest point P1 of a rotational trace of the drum and a motion of falling down to a point located between a point P2 spaced apart from the lowest point by 90 degrees and a point P3 spaced apart from the lowest point by 180 degrees.

Although the first acceleration mode S31 executed in the early drying stage (i.e., an early stage of the air supplying step) can minimize the problem that the laundry is damaged by the frictional force, if the first acceleration mode S31 is executed without interruption, it may cause a problem that a specific area of the laundry (e.g., one surface of the laundry facing the center of the drum) exchanges heat with the air supplied by the supply part 3 only. The first deceleration mode S33 is a means for solving such a problem. Namely, if the first acceleration mode S31 and the first deceleration mode S33 are executed alternately, the area of the laundry facing the rotation center of the drum can be changed, thereby preventing the problem of drying a prescribed area of the laundry only.

In addition, if the first acceleration mode S31 and the first deceleration mode S33 are executed alternately, a force, as shown in FIG. 12C, will be applied to the laundry. Namely, if the first acceleration mode S31 and the first deceleration mode S33 are repeated, centrifugal forces facing opposite directions can be alternately supplied to the laundry, thereby facilitating the prevention of contraction of the laundry.

In order to implement an effect of causing damage to laundry by a frictional force, and effect of maximizing a surface (i.e., contact surface) of laundry contacting with air, and an effect of removing creases from laundry, an execution time of the first acceleration mode S31 is preferably set longer than that of the first deceleration mode S33. That is, if the execution time of the first deceleration mode becomes longer than that of the first acceleration mode, a time and frequency of a frictional force applied to laundry will increase.

A ratio of the execution time of the first acceleration mode S31 to that of the first deceleration mode S33 may be set to 3:1~10:1. To implement the above effects more outstandingly, ratio of the execution time of the first acceleration mode S31 to that of the first deceleration mode S33 is preferably set equal to or higher than 5:1.

If a maintained time of the first acceleration mode S31 is set equal to or greater than 180 seconds, it is confirmed as effective in minimizing a frictional force supplied to laundry and removing creases from the laundry. If a maintained time of the first deceleration mode S33 is set equal to or greater than 60 seconds, it is confirmed as effective in agitating laundry. Furthermore, the alternate execution of the first acceleration mode S31 and the first deceleration mode S33 is set to be repeated twice at least, it is also confirmed that the above-described effects can be easily achieved.

If a diameter of the drum is set to 24 to 27 inches, the rpm of the drum configured in the first acceleration mode S31 may be set equal to or greater than 65 rpm and the rpm of the drum configured in the first deceleration mode S33 may be set equal to or greater than 50 rpm.

To minimize the load inputted to the drive part D, a rotational direction of the drum configured in the first acceleration mode S31 is preferably set equal to that of the drum configured in the first deceleration mode S33.

A drying process (i.e., air supplying step) of laundry is divided into a first period (e.g., a preheating period) in which a temperature of laundry increases while a dryness degree barely changes, a second period (i.e., a constant drying rate period) in which a dryness degree rapidly increases (i.e., a moisture content rapidly decreases) but a temperature of laundry barely changes, and a third period (i.e., a falling drying rate period) in which a temperature of laundry increases while a dryness degree barely changes.

The aforementioned first motion executing step S30 may be configured to be executed in a prescribed portion of the preheating period only or from the beginning to the end of the preheating period.

In case that the first motion executing step S30 is executed in the prescribed portion of the preheating period, first motion executing step S30 may be configured to start from an initiation time of the preheating period or a time of a lapse of a prescribed time since the initiation time and end before the end of the preheating period.

Whether the first motion executing step S30 ends or not may be determined depending on whether a dryness degree of laundry has reached a preset first reference dryness degree. Whether a dryness degree of laundry has reached a preset first reference dryness degree may be configured to be determined based on data measured via the sensing part 13 [S35]. Namely, the control method according to the present embodiment may be configured to end the first motion executing step S30 when a temperature of a refrigerant circulating in the refrigerant pipe 348 reaches a first refrigerant temperature.

Although whether a dryness degree has reached the first reference dryness degree may be determined via a multitude of the electrodes 131 and 133 configured to contact with laundry or the temperature sensor 135 measuring a temperature of air having flown into the exhaust duct 31, it may be also determined via the temperature sensor 137 sensing a temperature of a refrigerant to secure high accuracy. Namely, if the dryness degree is determined via the electrodes 131 and 133, accuracy may be lowered due to a laundry-to-electrode contact frequency and the like. If the dryness degree is determined based on a temperature of air discharged from the drum, accuracy may be lowered depending on a dispersed extend of laundry within the drum. On the other hand, since a temperature of a refrigerant is the data relatively less affected by the dispersed state of laundry within the drum, it is preferable that the step S35 of determining whether the first reference dryness degree has been reached is configured with a step of comparing a temperature of a refrigerant with a preset first refrigerant temperature.

The first refrigerant temperature may be set to 90° C. The temperature sensor 137 configured to measure a temperature of a refrigerant may be configured to measure a temperature of a refrigerant moving from the compressor 345 to the heating part 343. The temperature sensor 137 measuring the temperature of the refrigerant may be configured to estimate the temperature of the refrigerant by measuring a temperature of the refrigerant pipe 348 or directly measure the temperature of the refrigerant.

Unlike FIG. 10, the first motion executing step S30 may be configured to end if a total execution time of the first acceleration mode S31 and the first deceleration mode S33 reaches a preset reference time. The reference time may be set to vary depending on an amount of laundry put into the drum. In this case, a laundry amount determining step of measuring an amount of laundry put into the drum may proceed before the initiation of the first motion executing step. The reference time may be configured to enable the controller to select one of a multitude of time data selected via tests.

In some implementations, the control method according to the present embodiment may be configured to include a dispersal motion executing step S20 to minimize a laundry tangle during the execution of the first acceleration mode S31.

The dispersal motion executing step S20 may be executed before the initiation of the air supplying step S11, at the same time of the initiation of the air supplying step S11, or before the initiation of the first motion executing step S30. FIG. 10 shows one example of a case that the dispersal motion execution step S20 is performed after the initiation of the air supplying step S11 and before the initiation of the first motion executing step S30.

As described above, the dispersal motion executing step S20 is a process for minimizing a risk of tangling laundry during rotation of the drum by evenly spreading the laundry within the drum. In the dispersal motion executing step S20, the drum 2 performs a dispersal motion.

As shown in FIG. 13A, the dispersal motion is a motion pattern of the drum that alternately executes a clockwise rotation and a counterclockwise rotation of the drum at a dispersal rpm (e.g., a fourth rpm). The dispersal rpm may be set to an rpm, of which a centrifugal force generated from laundry is smaller than 1G. If a diameter of the drum is set to 24 to 27 inches, the dispersal rpm may be set to 30 rpm.

While the dispersal motion is in progress, the laundry will repeat ascent and drop within the drum 2. Namely, when the dispersal motion is in progress, the laundry may perform a motion of ascending up to the horizontal line H passing through the rotation center of the drum by the lifter 26 provided to the drum body 21, the frictional force, the centrifugal force and the like and then sliding or rolling down to the lowest point of the drum. As shown in FIG. 10, the dispersal motion executing step S20 may be configured to end if the preset dispersion time expires [S25].

If the first motion executing step ends S35, the control method may perform an agitating motion executing step S40 of rotating the drum 2 by a motion different from the first motion.

Figure 14A:
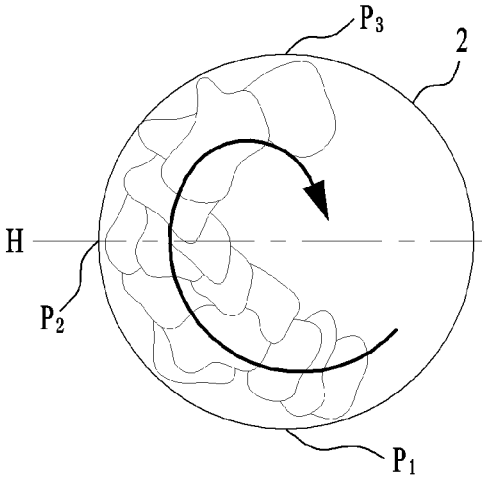
Figure 14B:
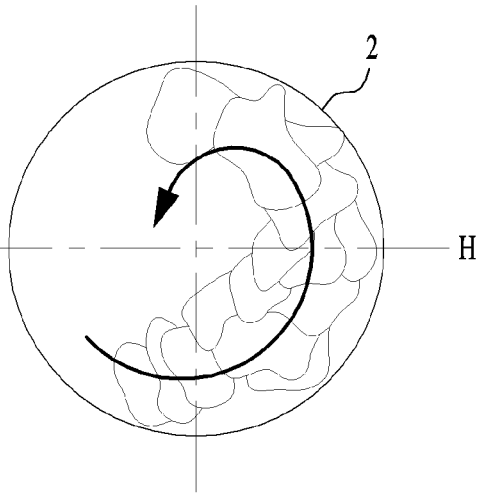

The agitating motion executing step S40 may be configured to activate the drum 2 in an agitation mode. As shown in FIGS. 14A and 14B, the agitation mode may be configured as a mode of alternately performing a clockwise rotation and a counterclockwise rotation of the drum 2 at a third rpm (i.e., an agitation rpm) smaller than the first rpm.

The third rpm may be set to an rpm that induces a centrifugal force for separating laundry from the drum between a point P2 spaced apart from a lowest point P of a rotational trace by 90° C. in a rotational direction of the drum and a point P3 spaced apart from the lowest point of the rotational trace by 180° C. in the rotational direction of the drum. Namely, the third rpm may be set to an rpm inducing a centrifugal force smaller than 1G or an rpm equal to the second rpm (i.e., the rpm configured in the first deceleration mode). Furthermore, the third rpm may be set to an rpm smaller than the second rpm and greater than the fourth rpm (i.e., the rpm configured in the dispersion mode).

FIG. 14A shows a process for rotating the drum 2 clockwise at the third rpm, and FIG. 14B shows a process for rotating the drum 2 counterclockwise at the third rpm. Unlike the drawing, the agitation mode may be configured to alternately perform a counterclockwise rotation and a clockwise rotation of the drum.

In the agitating motion executing step S40, the laundry will repeat a process of clockwise ascending to a space over the horizontal line H passing through the center of the drum, a process of falling or rolling to a space located under the horizontal line H, a process of counterclockwise ascending to the space located over the horizontal line H, and a process of falling or rolling to the space located under the horizontal line H.

The agitating motion executing step S40 may be preferably configured to be performed in the constant drying rate period. The agitating motion executing step S40 may be configured to be performed in some or whole of the constant drying rate period.

If the agitating motion executing step S40 is performed in the constant drying rate period, a space (i.e., a contact surface) of the laundry contactable with air is maximized, whereby a reduction effect of a drying time can be expected. In addition, since the laundry keeps being moved within the drum in the agitating motion executing step S40, the risk of color contamination occurring due to laundry-to-laundry contact can be minimized.

The agitating motion executing step S40 may be configured to end when the dryness degree of the laundry reaches a preset agitation end dryness degree (i.e., a third reference dryness degree) [S45] or when the execution time of the agitation mode reaches a preset reference time (i.e., a agitating motion execution time). FIG. 10 shows one example of the former case. In the latter case, a progress time of the agitating motion executing step S40 is preferably set longer than that of the first motion executing step S30.

The agitation end dryness degree may be set to a dryness degree of a timing point at which the constant drying rate period ends (i.e., a timing point at which the falling drying rate period is initiated). The agitation end dryness degree may be set to a dryness degree having a moisture content equal to or smaller than 10%.

If a dryness degree is configured as determined via a temperature of a refrigerant, the control method may determine that the agitation end dryness degree is reached when a temperature of a refrigerant measured by the temperature sensor 137 reaches an agitation end refrigerant temperature (this may be set different depending on a temperature of a refrigerant, which is discharged from the compressor when the moisture content is equal to or smaller than 10%, and a laundry amount).

If the measured dryness degree of the laundry is equal to or higher than the agitation end dryness degree in the course of the agitating motion executing step S40 [S45], the control method may be configured to progress a second motion executing step S50 of alternately executing a second acceleration mode S51 and a second deceleration mode S53.

The second acceleration mode S51 and the second deceleration mode S53 provided to the second motion executing step S50 may be configured identical to the first acceleration mode S31 and the first deceleration mode S33. Namely, the second acceleration mode S51 provided to the second motion executing step S50 may be configured as shown in FIG. 11A, and the second deceleration mode S53 may be configured as shown in FIG. 111B.

Since the falling drying rate period is in a state that a dryness degree of laundry is high, as the frequency of friction between the laundry and the drum increases, the risk of laundry abrasion (fluffing) increases. Hence, if a second motion of alternately executing the second acceleration mode S51 and the second deceleration mode S53 is performed in the falling drying rate period, the number of frictions between the laundry and the drum is minimized to lower the risk of laundry damage.

As the agitating motion executing step S40 maximizes a motion of laundry, an effect of reducing a drying time may be expected. Yet, a lot of impact on the laundry may cause a problem of laundry contraction (reducing the volume of space formed between fibers). The second motion executing step S50 is a means for minimizing the risk of laundry contraction by reducing the impact on the laundry.

A ratio of an execution time of the second acceleration mode S51 provided to the second motion executing step S50 to that of the second deceleration mode S51 provided thereto may be set different from that of the execution time of the first acceleration mode S31 to that of the first deceleration mode S33.

If a time of the second acceleration mode S51 gets excessively longer than that of the second deceleration mode S53, the risk of damage caused to laundry by a tensile force applied to the laundry may be increased. Hence, it is preferable that the execution time configured for the second acceleration mode S51 is set equal to or longer than the execution time configured for the second deceleration mode S53. A ratio of the execution time of the second acceleration mode S51 to that of the second deceleration mode S53 is equal to or smaller than 5:1 (preferably, 3:1~1:1), and a maintained time of each of the second acceleration mode S51 and the second deceleration mode S53 may be set to 60 seconds or more.

As shown in FIG. 10, the second motion executing step S50 is performed until a dryness degree of laundry reaches a preset second reference dryness degree [S55]. The second reference dryness degree may be set to a dryness degree higher than the agitation end dryness degree and lower than a target dryness degree (e.g., a target dryness degree set in the air supplying step) set for the drying course selected (S10) by the user.

The step S55 of determining whether the dryness degree of the laundry reaches the second reference dryness degree may be performed in a manner that the controller monitors dryness degree data transmitted from the sensing part 13. Namely, when the temperature of the refrigerant discharged from the compressor 345 reaches a preset second refrigerant temperature, the control method may determine that the second reference dryness degree has been reached.

If the dryness degree of the laundry is determined as having reached the second reference dryness degree, the control method may execute a sensing motion executing step S60 and a sensing step S65 (i.e., a second sensing step).

The sensing motion executing step S60 is a process for enabling the laundry to flow in the space under the horizontal line H passing through the rotation center of the drum, and the second sensing step S65 is a process for measuring the dryness degree of the laundry via the first electrode 131 and the second electrode 133.

In the sensing motion executing step S60, the drum 2 may rotate in the sensing mode shown in FIG. 13B. As shown in FIG. 13B, the drum 2 alternately performs a clockwise rotation and a counterclockwise rotation in the sensing mode. In doing so, a drum rpm (i.e., a sensing rpm or a fifth rpm) set in the sensing mode is preferably set lower than the drum rpm (i.e., the fourth rpm) set in the dispersion mode. If a diameter of the drum is set to 24 to 27 inches, the sensing rpm may be set equal to or smaller than 20 rpm.

While the sensing motion executing step S60 is in progress, a flowing range of the laundry is limited to the space located under the horizontal line H and a moving speed of the laundry becomes relatively uniform (i.e., a motion of the laundry can be maintained comparatively even). Therefore, an accurate dryness degree of the laundry can be relatively measured using the first electrode 131 and the second electrode 133.

In addition, the sensing motion executing step S60 minimizes the contact area between laundry and air (e.g., the heat exchange between the laundry and air), thereby minimizing the damage caused to the laundry by over-drying.

Although not shown in the drawing, if the dryness degree of the laundry measured in the course of the second motion executing step S50 is determined as equal to or greater than the second reference dryness degree [S55], the control method may decrease an amount of the air supplied to the drum 2. This is to minimize a problem that a light laundry blocks the first outlet 128 (e.g., overheating of the heat exchange part, damage caused to laundry, etc.). The amount of the air supplied to the drum 2 may be reduced in a manner that the controller lowers an rpm of the fan 315.

As shown in FIG. 10, if the dryness degree measured (S65) in the course of the sensing motion executing step is determined as having reached the preset target dryness degree [S14], the control method ends the air supplying step S11, the dryness degree measuring step S12 and the rotation of the drum 2.

Unlike the drawing, when both of the dryness degree measured via the electrodes 131 and 133 and the dryness degree measured via the temperature sensor 137 measuring the temperature of the refrigerant each the target dryness degree, the control method may be configured to end the air supplying step S11, the dryness degree measuring step S12 and the rotation of the drum 2.

Figure 15:
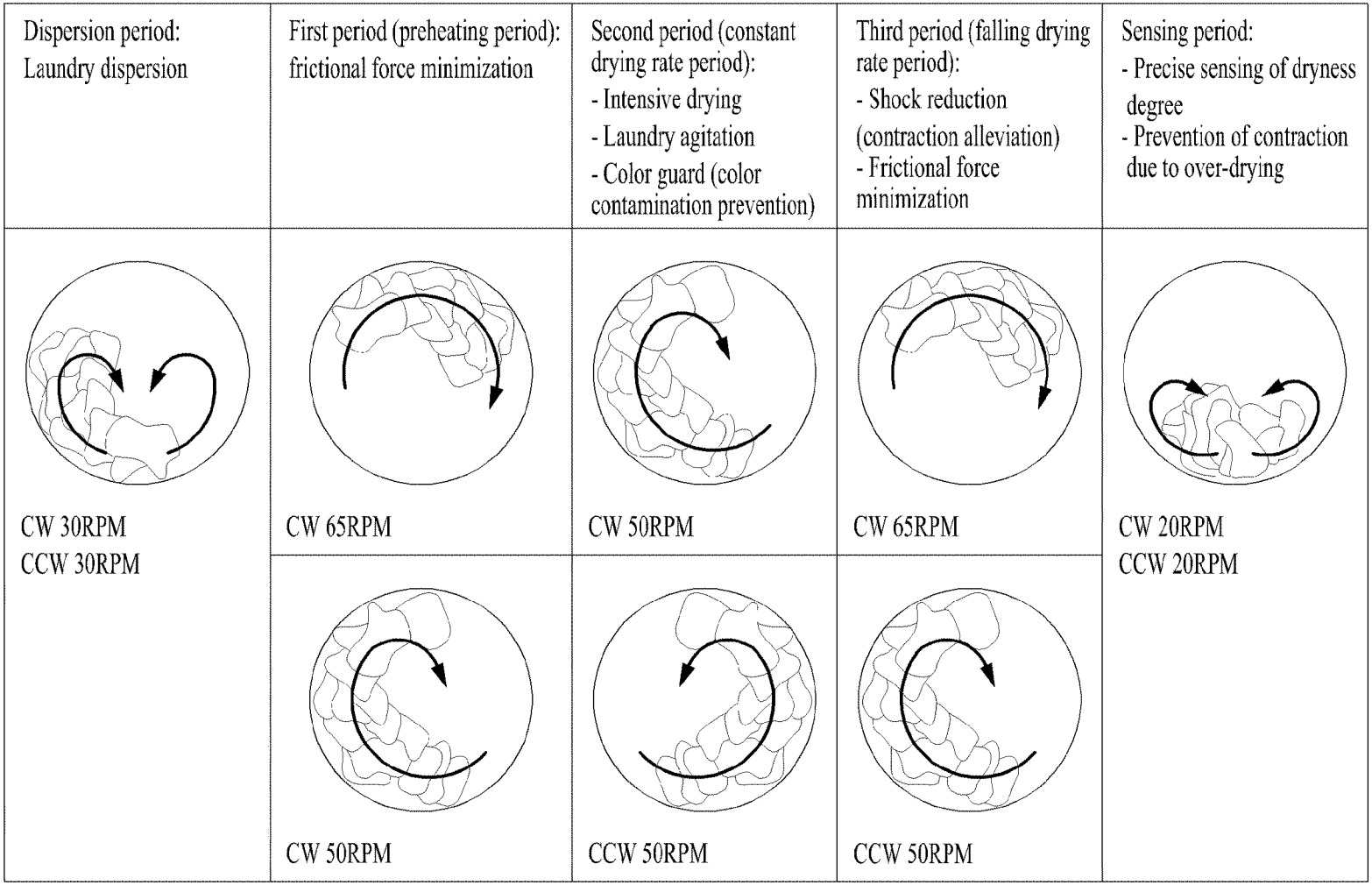
FIG. 15 shows a drum motion and effect per period of a drying course.

FIG. 15 shows a drum motion and effect per period. In the dispersal motion executing step S20, the drum performs a dispersal motion so that laundry is evenly spread in the drum. Thereafter, in the first motion executing step S30, the drum rotates according to the first acceleration mode and the first deceleration mode to minimize the frictional force between the laundry and the drum. In the agitating motion executing step S40, the drum rotates according to the agitation mode to activate the heat exchange between the laundry and air. In the second motion executing step S50, the drum rotates according to the second acceleration mode and the second deceleration mode to minimize the contraction and damage of the laundry. After completion of the second motion executing step S50, the drum rotates according to the sensing mode, whereby the sensing part 4 may sense the dryness degree precisely.

Figure 16:
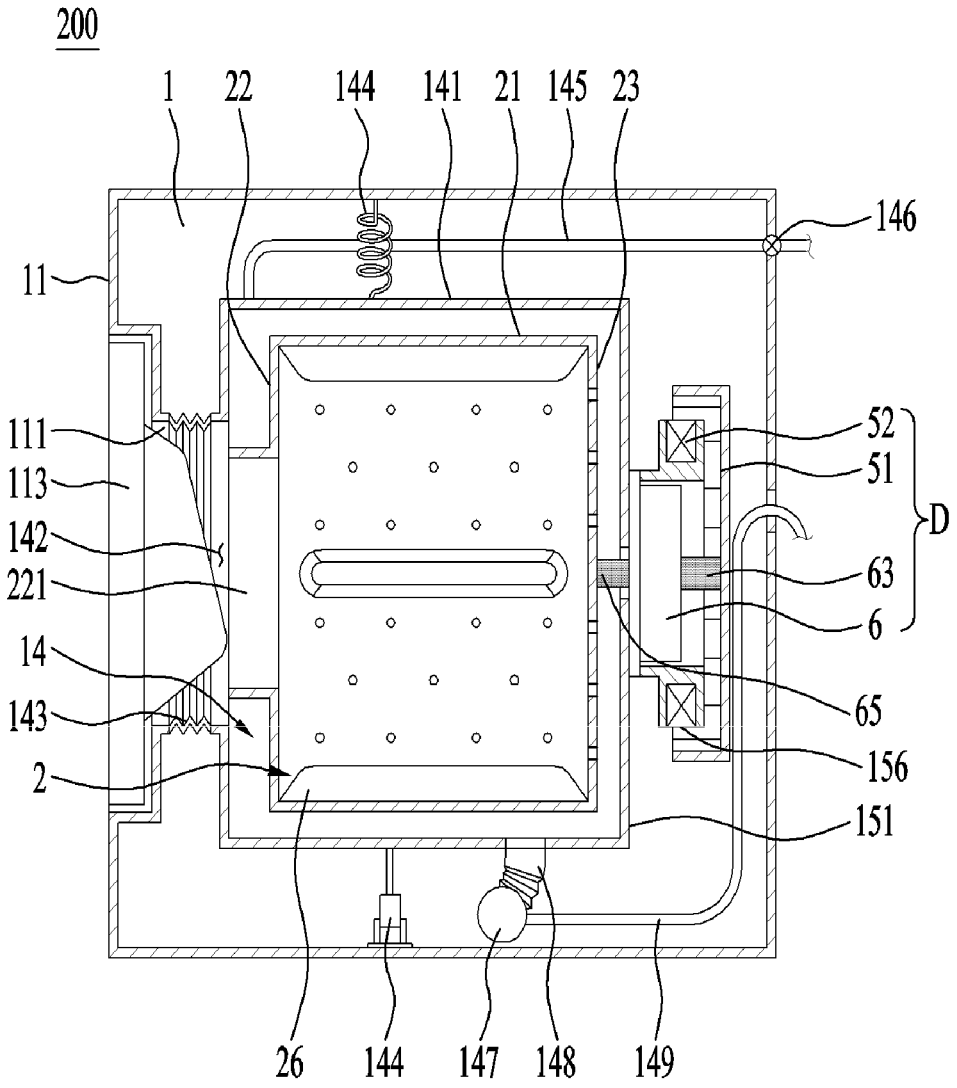
FIG. 16 shows a laundry treating apparatus according to another embodiment.

The above-described structure and control method of the laundry treating apparatus are described with reference to a device for drying laundry, they are applicable to a device for washing laundry. FIG. 16 shows one example of a device capable of washing laundry.

Referring to FIG. 16, a laundry treating apparatus 200 may include a cabinet 1 having an entrance 111 provided to a front panel 11, a tub 14 provided within the cabinet to provide a space for storing water therein, a drum 2 provided within the tub to store laundry therein, and a drive part D fixed to the tub to rotate the drum. In this case, a drum perforated hole enabling an inside of the drum to communicate with an inside of the tub should be provided to the drum 2.

The tub 14 may include a tub body 141 in a hollow cylindrical shape, a water supply part 145 and 146 supplying water to the tub body, and a drain part 147, 148 and 149 discharging the water stored in the tub body to an outside of the cabinet.

The tub body 141 may be fixed to an inside of the cabinet 1 via a tub support part 144. A tub entrance 142 connected to the entrance 111 through a gasket 143 in a cylindrical shape may be provided to a front side of the tub body 141.

The water supply part may include a water supply pipe 145 connecting a water supply source and the tub body 141 together and a water supply valve 146 controlling the water supply pipe to be open or closed. The discharge part may include a pump 147, a first drain pipe 148 connecting the tub body and the pump together, and a second drain pipe 149 guiding water discharged from the pump to an outside of the cabinet 1.

Although not shown in the drawing, the laundry treating apparatus shown in FIG. 16 may further include a supply part configured to supply air to the tub body 141 to remove moisture from the laundry stored in the drum. The supply part included in the present embodiment may include an exhaust duct discharging air in the tube body to an outside of the tub body, a heat exchange part provided to the exhaust duct to sequentially perform dehumidification and heating, and a supply duct guiding the air through the heat exchange part to the tub body. A rear side of the tub body 141 in the laundry treating apparatus shown in FIG. 16 may play a role as the fixed panel 151 provided to the embodiment shown in FIG. 1 and FIG. 2.

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A method of controlling a dryer including a drum providing a space for storing laundry therein, an exhaust duct discharging air in the drum, a supply duct supplying air to the drum, and a heat exchange part heating the air supplied to the drum, the method comprising:

an air supplying step of supplying heated air to the drum through the heat exchange part; and a first motion executing step executed while the air supplying step is in progress, wherein the first motion executing step comprises alternately executing (i) a first acceleration mode of rotating the drum at an rpm inducing a centrifugal force equal to or greater than 1G along one of a clockwise direction or a counterclockwise direction and (ii) a first deceleration mode of rotating the drum at an rpm inducing a centrifugal force smaller than 1G in a direction equal to a rotational direction set for the first acceleration mode, wherein the rotation direction of the drum is maintained during the first acceleration mode and the first deceleration mode of the first motion executing step, and wherein the first acceleration mode and the first deceleration mode are performed consecutively without a time gap therebetween.

2. The method of claim 1, wherein the air supplying step is divided into a preheating period, a constant drying rate period and a falling drying rate period, and wherein the first motion executing step is executed in a partial or whole period of the preheating period.

3. The method of claim 2, wherein the first motion executing step is performed until a dryness degree of the laundry reaches a preset first reference dryness degree.

4. The method of claim 3, wherein the exhaust duct and the supply duct are connected together to configure a circulation flow path of air, wherein the heat exchange part comprises a refrigerant pipe forming a flow path having a refrigerant circulating therein, a heat absorbing part transferring heat of air flowing into the exhaust duct to the refrigerant, a heating part transferring heat of the refrigerant to air having passed through the heat absorbing part, and a compressor enabling the refrigerant to circulate along the refrigerant pipe, and wherein the first reference dryness degree is determined based on whether a temperature of the refrigerant discharged from the compressor reaches a preset first refrigerant temperature.

5. The method of claim 3, further comprising:

a second motion executing step of alternately executing a second acceleration mode of rotating the drum at an rpm inducing a centrifugal force equal to or greater than 1G along one of the clockwise direction or the counterclockwise direction and a second deceleration mode of rotating the drum at an rpm inducing a centrifugal force smaller than 1G in a direction equal to a rotational direction set for the second acceleration mode, wherein the second motion executing step is executed in a partial or whole period of the falling drying rate period.

6. The method of claim 5, wherein the second motion executing step ends if the dryness degree of the laundry reaches a second reference dryness degree set smaller than a target dryness degree set for the air supplying step.

7. The method of claim 6, wherein the exhaust duct and the supply duct are connected together to configure a circulation flow path of air, wherein the heat exchange part comprises a refrigerant pipe forming a flow path having a refrigerant circulating therein, a heat absorbing part transferring heat of air flowing into the exhaust duct to the refrigerant, a heating part transferring heat of the refrigerant to air having passed through the heat absorbing part, and a compressor enabling the refrigerant to circulate along the refrigerant pipe, and wherein the second reference dryness degree is determined based on whether a temperature of the refrigerant discharged from the compressor reaches a preset second refrigerant temperature.

8. The method of claim 5, wherein a ratio of an execution time of the first acceleration mode to an execution time of the first deceleration mode is set different from that of the second acceleration mode to the second deceleration mode.

9. The method of claim 8, wherein the execution time set for the first acceleration mode is longer than the execution time set for the first deceleration mode.

10. The method of claim 9, wherein the ratio of the execution time of the first acceleration mode to the execution time of the first deceleration mode is set to 3:1~10:1.

11. The method of claim 8, wherein an execution time set for the second acceleration mode is set equal to or longer than an execution time set for the second deceleration mode.

12. The method of claim 11, wherein the ratio of the execution time of the second acceleration mode to the execution time of the second deceleration mode is set to 1:1~3:1.

13. The method of claim 5, further comprising an agitating motion executing step of alternately performing a clockwise rotation and a counterclockwise rotation of the drum at the rpm inducing the centrifugal force smaller than 1G, wherein the agitating motion executing step is executed in the constant drying rate period.

14. The method of claim 13, further comprising a dispersal motion executing step of being executed before initiation of the first motion executing step and alternately performing the clockwise rotation and the counterclockwise rotation of the drum at the rpm inducing the centrifugal force smaller than 1G.

15. The method of claim 14, wherein an rpm of the drum set in the dispersal motion executing step is lower than the rpm of the drum set in the agitating motion executing step.

16. The method of claim 15, further comprising:

a sensing motion executing step of rotating the drum at an rpm lower than the rpm set in the dispersal motion executing step after completion of the second motion executing step; and a sensing step of measuring the dryness degree of the laundry via electrodes provided to contact with the laundry located under a horizontal line passing through a rotation center of the drum, wherein if the dryness degree of the laundry measured in the sensing step is equal to or higher than a target dryness degree set for the air supplying step, the air supplying step is ended.

17. A method of controlling a laundry treating apparatus including a drum providing a space for storing laundry therein, a fixed panel provided to a location spaced apart from a rear side of the drum, a stator fixed to the fixed panel to form a rotating field, a rotor configured to be rotated by the rotating field to generate power required for rotation of the drum, a panel outlet configured to perforate the fixed panel, an exhaust duct guiding air discharged from the drum to the panel outlet, a heat exchange part dehumidifying and heating air moving along the exhaust duct, an inlet configured in a manner that a multitude of perforated holes configured to perforate the fixed panel are disposed to enclose the rotor, an air inlet configured in a manner that a multitude of perforated holes perforating the rear side of the drum are disposed to form a ring enclosing a rotation center of the drum, a flow path forming part having one end fixed to the fixed panel to enclose the inlet and the other end contacting with the drum to enclose the air inlet, and a supply duct fixed to the fixed panel to guide air discharged from the panel outlet to the inlet, the method comprising:

an air supplying step of supplying heated air to the drum through the heat exchange part; and a motion executing step executed while the air supplying step is in progress, wherein the motion executing step alternately executes an acceleration mode of rotating the drum at an rpm inducing a centrifugal force equal to or greater than 1G along one of a clockwise direction and a counterclockwise direction and a deceleration mode of rotating the drum at an rpm inducing a centrifugal force smaller than 1G in a direction equal to a rotational direction set for the acceleration mode, and wherein the acceleration mode and the deceleration mode are performed consecutively without a time gap therebetween.

18. The method of claim 17, wherein the air supplying step is divided into a preheating period, a constant drying rate period and a falling drying rate period and wherein the motion executing step is executed in at least one of the preheating period or the falling drying rate period.

19. The method of claim 17, wherein the air inlet is provided to a location capable of discharging air to the laundry adhering closely to a circumferential surface of the drum.

* * * * *